US011927008B2

(12) United States Patent
Giacomini

(10) Patent No.: US 11,927,008 B2
(45) Date of Patent: Mar. 12, 2024

(54) EXTENDABLE STRUCTURE AND RELATIVE MOVEMENT METHOD

(71) Applicant: GRUPPO ITALTELO S.P.A., Montichiari (IT)

(72) Inventor: Italo Giacomini, Prevalle (IT)

(73) Assignee: GRUPPO ITALTELO S.P.A., Montichiari (IT)

( * ) Notice: Subject to any disclaimer, the term of this patent is extended or adjusted under 35 U.S.C. 154(b) by 143 days.

(21) Appl. No.: 17/430,272

(22) PCT Filed: Feb. 12, 2020

(86) PCT No.: PCT/IB2020/051132
§ 371 (c)(1),
(2) Date: Aug. 11, 2021

(87) PCT Pub. No.: WO2020/165791
PCT Pub. Date: Aug. 20, 2020

(65) Prior Publication Data

US 2022/0127840 A1 Apr. 28, 2022

(30) Foreign Application Priority Data

Feb. 13, 2019 (IT) ..... 102019000002115

(51) Int. Cl.
*E04B 1/344* (2006.01)
*E04B 1/343* (2006.01)

(52) U.S. Cl.
CPC ..... *E04B 1/3442* (2013.01); *E04B 1/34384* (2013.01)

(58) Field of Classification Search
CPC ... E04B 1/3442; E04B 1/34384; E04B 1/3444
See application file for complete search history.

(56) References Cited

U.S. PATENT DOCUMENTS 2,098,469 A * 11/1937 Smith ..... A47D 13/065 52/66
3,792,557 A * 2/1974 Pitts ..... E04B 1/3444 52/65

(Continued)

FOREIGN PATENT DOCUMENTS

CN 105438052 A 3/2016
CN 206090845 U 4/2017
CN 108487469 A 9/2018

OTHER PUBLICATIONS

First examination report for European Application No. 20709323.8 (5 pages). (Year: 2023).*

(Continued)

*Primary Examiner* — Rodney Mintz
(74) *Attorney, Agent, or Firm* — MH2 TECHNOLOGY LAW GROUP LLP

(57) ABSTRACT

An extendable structure adapted to operate between a retracted configuration and at least one at least partially extended configuration includes a box-like body, a foldable floor element, and a foldable ceiling element. The box-like body includes a first and a second upright. The foldable floor element is hinged at a lower portion of the uprights and is configured for being folded and spread out. The foldable ceiling element is hinged at an upper portion of the uprights and is configured for being folded and spread out. In the retracted configuration of the extendable structure, the foldable floor element and the foldable ceiling element are completely housed within the box-like body, which defines an overall size of the extendable structure.

8 Claims, 11 Drawing Sheets

(56) References Cited

U.S. PATENT DOCUMENTS

| | | | | |
|---|---|---|---|---|
| 4,118,901 | A * | 10/1978 | Johnson | E04B 1/3445 52/18 |
| 4,603,658 | A * | 8/1986 | Garnsey | A01K 1/033 119/499 |
| 4,989,379 | A | 2/1991 | Suzuki | |
| 7,475,514 | B2 * | 1/2009 | Rulquin | E04B 1/3445 52/79.5 |
| 8,806,810 | B2 * | 8/2014 | Barragan Olaya | E04B 1/3445 52/79.5 |
| 8,863,446 | B2 * | 10/2014 | Strachan | E04C 2/28 52/79.5 |
| 10,753,079 | B2 * | 8/2020 | Rulquin | E04B 1/3445 |
| 11,555,305 | B2 * | 1/2023 | Hariri | E04B 1/34336 |
| 2006/0248809 | A1 * | 11/2006 | Rulquin | E04B 1/3445 52/79.5 |
| 2012/0311939 | A1 * | 12/2012 | Barragan Olaya | E04H 1/1205 52/79.5 |
| 2012/0317898 | A1 * | 12/2012 | Strachan | E04B 1/34336 52/79.5 |
| 2017/0284080 | A1 * | 10/2017 | Vidal de la Fuente | E04B 7/022 |
| 2019/0257072 | A1 * | 8/2019 | Rulquin | E04B 1/3431 |
| 2021/0404170 | A1 * | 12/2021 | Hariri | E04B 1/34363 |

OTHER PUBLICATIONS

Search Report dated May 8, 2020 in corresponding International Application No. PCT/IB2020/051132, 3 pages.
Written Opinion dated May 8, 2020 in corresponding International Application No. PCT/IB2020/051132, 6 pages.

* cited by examiner

EXTENDABLE STRUCTURE AND RELATIVE MOVEMENT METHOD

CROSS-REFERENCE TO RELATED APPLICATIONS

This application is a U.S. National Stage application of PCT/IB2020/051132 filed Feb. 12, 2020, pending, which claims priority to Italian Application No. 102019000002115 filed Feb. 13, 2019, the entire disclosures of which are hereby incorporated by reference.

TECHNICAL FIELD OF THE INVENTION

The present description relates to an extendable structure. In the context of the present description, by structure it is intended a structure that is suitable, in at least one operative configuration thereof, to house one or more users and/or one or more furnishing elements. The present description also regards a method for moving an extendable structure.

Prior Art

Structures are known which are adapted to operate between a rest configuration and an operative configuration with greater volume. Such structure type usually has a plurality of portions which can be moved in a relative manner, starting from the rest configuration, so as to define an operative configuration of the structure.

The patent document EP0942106A2 discloses an extendable structure whose volume can be increased, starting from a closed configuration, by suitably orienting a plurality of panels. The relative movement between panels is allowed by kinematic mechanisms which comprise pulleys, toothed wheels and flexible cables. The extendable structure described in EP0942106A2 nevertheless has drawbacks. Such structure is first of all very bulky even in its closed configuration and the complex kinematic mechanisms do not allow a quick, easy and effective arrangement thereof. In addition, the provision of complex kinematic mechanisms considerably increases the costs of making the extendable structure.

The United States patent document U.S. Pat. No. 5,265,394A shows an expandable structure comprising a fixed portion and a movable portion pivoted to the fixed portion. In the retracted position, the movable portion encloses the fixed portion while in the expanded position the movable portion and the fixed portion cooperate in order to define a volume of the structure. The passage from the retracted position to the expanded position is made by means of rotation of the movable portion with respect to the fixed portion. A hoist is provided for moving the movable portion between the expanded positions and the retracted position. The expandable structure described in U.S. Pat. No. 5,265,394A nevertheless has several drawbacks. Such structure is considerably bulky also in its retracted position and, in addition, the movement of the movable portion with respect to the fixed portion is not easy.

A further expandable structure is shown in the patent document JP2011236714A. Such structure comprises three units telescopically housed within a base box-like unit. In order for them to be telescopically housed within the base box-like unit, the three units have respective volumes different from each other and smaller than the volume of the base box-like unit. By extracting the three units from the base box-like unit, the structure takes on an expanded configuration with greater volume. The expandable structure described in JP2011236714A nevertheless has several drawbacks. In particular, such structure is quite voluminous in its position with minimum size, in which the three units are housed within the base box-like unit. In addition, a further drawback is constituted by the fact that, since the units have different volumes from each other, the volume of the expanded structure decreases starting from the base box-like unit down to the smallest volume unit telescopically housed within the others.

In light of that stated above, the extendable or expandable structures of known type have drawbacks and they can be improved with regard to multiple standpoints.

OBJECTS OF THE INVENTION

The main object of the present description is to provide an extendable structure capable of overcoming one or more of the drawbacks described above in relation to the prior art.

The object of the present description is to provide an extendable structure which is, in a retracted configuration, compact and having limited size.

Object of the present description is also that of providing an extendable structure which is, in an extended configuration, voluminous and spacious.

One object of the present description is to provide an extendable structure which is easily transportable.

Another object of the present description is to have an extendable structure with limited weight.

Another object of the present description is to provide an extendable structure that can be autonomously supported, from a structural standpoint, without the aid of external support elements outside the extendable structure.

An additional object of the present description is to provide an extendable structure that can be set up and retracted, if necessary, easily and in limited times.

Further main object of the present description is that of providing a method for moving an extendable structure capable of overcoming one or more of the drawbacks described above in relation to the prior art.

An additional object of the present description consists of disclosing a method for moving an extendable structure which allows setting up and retracting an extendable structure, if necessary, by means of a few simple steps.

An additional object of the present description is that of providing a method for moving an extendable structure which allows setting up and retracting an extendable structure, if necessary, easily and in limited times.

A further object of the present description is a method for moving an extendable structure which allows setting up or retracting an extendable structure without the aid of tools.

The above-highlighted objects and still others are attained by an extendable structure, by a method for moving an extendable structure and by a use of the extendable structure in accordance with the enclosed claims and/or with the following aspects, which can be taken independently from each other or in combination with any one of the following aspects or in combination with the single technical characteristics described in the detailed description or in combination with any one of the enclosed claims.

SUMMARY

In a first aspect, the invention relates to an extendable structure adapted to operate between a retracted configuration and at least one at least partially extended configuration, the extendable structure comprising:

a box-like body comprising at least one upright, a foldable floor element hinged in proximity to or at a lower portion of said at least one upright, in the retracted configuration of the extendable structure the floor element being folded and being placed in proximity to said at least one upright, in a step of opening the extendable structure—aimed to determine the transition of the extendable structure from the retracted configuration to said at least one at least partially extended configuration—the floor element being transversely spread out and at least partially away from said at least one upright, and/or a foldable ceiling element hinged in proximity to or at an upper portion of said at least one upright, in the retracted configuration of the extendable structure the ceiling element being folded and being placed in proximity to said at least one upright, in a step of opening the extendable structure—aimed to determine the transition of the extendable structure from the retracted configuration to said at least one at least partially extended configuration—the ceiling element being transversely spread out and at least partially away from said at least one upright.

In one aspect, in the retracted configuration of the extendable structure, the floor element and the ceiling element are housed within the box-like body.

In one aspect, in the retracted configuration of the extendable structure, the floor element and the ceiling element are housed in folded configuration within the box-like body.

In one aspect, the box-like body defines an overall size of the extendable structure.

In one aspect, a width of said at least one upright defines, in the retracted configuration of the extendable structure, a width of the box-like body.

In one aspect, in a completely extended configuration of the extendable structure, the floor element is substantially flat and/or transverse to said at least one upright.

In one aspect, in a completely extended configuration of the extendable structure the ceiling element is substantially flat and transverse to said at least one upright.

In one aspect, the ceiling element and the floor element are extended at and/or emerge from a same side of said at least one upright and are configured for being moved in a mirrored manner with respect to a plane crossing through a center line of said at least one upright orthogonal to a main extension direction of said at least one upright.

In one aspect, the center line is defined with reference to the main extension direction of said at least one upright.

In one aspect, the center line of said at least one upright corresponds with a half-height of said at least one upright.

In one aspect, said at least one upright has a height defined along the, or parallel to the, main extension direction of said at least one upright.

In one aspect, the foldable ceiling element comprises a first foldable ceiling portion and a second foldable ceiling portion extending at and/or emerging from opposite sides of said at least one upright and the foldable floor element comprises a first foldable floor portion and a second foldable floor portion extending at and/or emerging from opposite sides of said at least one upright.

In one aspect, the first foldable ceiling portion and the second foldable ceiling portion are configured for being moved in a mirrored manner with respect to a plane crossing through said at least one upright parallel to a main extension direction of said at least one upright.

In one aspect, the first foldable floor portion and the second foldable floor portion are configured for being moved in a mirrored manner with respect to a plane crossing through said at least one upright parallel to a main extension direction of said at least one upright.

In one aspect, the ceiling element and the floor element are substantially parallel to each other in the completely extended configuration of the extendable structure.

In one aspect, the first foldable ceiling portion and the first foldable floor portion are substantially parallel to each other in the completely extended configuration of the extendable structure.

In one aspect, the second foldable ceiling portion and the second foldable floor portion are substantially parallel to each other in the completely extended configuration of the extendable structure.

In one aspect, the first foldable ceiling portion and the second foldable ceiling portion are substantially coplanar to each other in the completely extended configuration of the extendable structure.

In one aspect, the first foldable floor portion and the second foldable floor portion are substantially coplanar to each other in the completely extended configuration of the extendable structure.

In one aspect, in the completely extended configuration of the structure, the ceiling element and the floor element are substantially orthogonal with respect to the upper portion and to the lower portion of said at least one upright.

In one aspect, the extendable structure also comprises at least one actuator configured for determining the transition of the extendable structure from the retracted configuration to said at least one at least partially extended configuration.

In one aspect, said at least one actuator is also configured for determining the transition of the extendable structure from said at least one at least partially extended configuration to the retracted configuration.

In one aspect, said at least one actuator is arranged at or in proximity to said at least one upright and is housed, in the retracted configuration of the extendable structure, within the box-like body.

In one aspect, said at least one actuator is operatively connected to at least one from between the floor element and the ceiling element and is configured for at least partially moving the floor element and/or the ceiling element.

In one aspect, the movement of the floor element and/or of the ceiling element causes the folding or the spreading out thereof.

In one aspect, said at least one actuator is configured for triggering and/or managing at least the step of opening the extendable structure, determining the transition of the extendable structure from the retracted configuration to said at least one at least partially extended configuration.

In one aspect, said at least one actuator is also configured for triggering and/or managing a step of closing the extendable structure, determining the transition of the extendable structure from said at least one at least partially extended configuration or from a completely extended configuration to the retracted configuration.

In one aspect, the extendable structure comprises a first actuator and a second actuator both arranged at or in proximity to said at least one upright and housed, in the retracted configuration of the extendable structure, within the box-like body.

In one aspect, the first actuator operates on the floor element.

In one aspect, the first actuator is operatively connected to the floor element and is configured for at least partially moving the floor element.

In one aspect, the second actuator operates on the ceiling element.

In one aspect, the second actuator is operatively connected to the ceiling element and is configured for at least partially moving the ceiling element.

In one aspect, the first actuator is configured for folding and spreading out the floor element.

In one aspect, the second actuator is configured for folding and spreading out the ceiling element.

In one aspect, the first actuator comprises a piston configured for pushing and/or pulling the floor element and also comprises a first arm and a second arm, the first arm being connected to a panel of a first foldable portion of the floor element and being interposed between said panel of the first foldable portion and the piston, the second arm being connected to a panel of a second foldable floor portion and being interposed between said panel of the second foldable floor portion and the piston.

In one aspect, the second actuator comprises a piston configured for pushing and/or pulling the ceiling element and also comprises a first arm and a second arm, the first arm being connected to a panel of a first foldable ceiling portion and being interposed between said panel of the first foldable ceiling portion and the piston, the second arm being connected to a panel of a second foldable ceiling portion and being interposed between said panel of the second foldable ceiling portion and the piston.

In one aspect, each piston comprises a terminal end provided with a hinge, the first and the second arm being hinged to the terminal end of the respective piston.

In one aspect, the first arm and the second arm are configured for being opened when subjected to the pushing action of the respective piston.

In one aspect, the first arm and the second arm are configured for being at least partially shut when subjected to the pulling action of the respective piston.

In one aspect, each actuator also comprises a seat, each piston being at least partially housed within the respective seat and being configured for translating with respect to the respective seat.

In one aspect, each piston is configured for telescopically translating with respect to the respective seat.

In one aspect, each seat is substantially cylindrical and/or comprises a cylinder.

In one aspect, each panel has a guide, one end of each arm being slidably housed within the respective guide.

In one aspect, the end of each arm slidably housed in the guide is opposite the end of the arm hinged to the piston.

In one aspect, each actuator comprises a motor configured for actuating the respective piston.

In one aspect, each piston has an extension direction substantially parallel to an extension direction of said at least one upright.

In one aspect, each seat has an extension direction substantially parallel to an extension direction of said at least one upright.

In one aspect, the extendable structure comprises a single motor configured for actuating, selectively or simultaneously, the piston of the first actuator and the piston of the second actuator.

In one aspect, the first actuator comprises a first piston and a second piston, the first piston being engaged with a first panel of the floor element and being configured for pushing and/or pulling the first panel, the second piston being engaged with a second panel of the floor element and being configured for pushing and/or pulling the second panel.

In one aspect, the first and the second piston of the first actuator are transverse to each other.

In one aspect, the second actuator comprises a first piston and a second piston, the first piston being engaged with a first panel of the ceiling element and being configured for pushing and/or pulling the first panel, the second piston being engaged with a second panel of the ceiling element and being configured for pushing and/or pulling the second panel.

In one aspect, the first and the second piston of the second actuator are transverse to each other.

In one aspect, each actuator comprises a first seat configured for housing the first piston and a second seat configured for housing the second piston.

In one aspect, each piston is at least partially housed within the respective seat and is configured for translating with respect to the respective seat.

In one aspect, each piston is configured for telescopically translating with respect to the respective seat.

In one aspect, each seat is substantially cylindrical and/or comprises a cylinder.

In one aspect, each panel has a guide, one end of each piston being slidably housed within the respective guide.

In one aspect, each actuator comprises a motor configured for actuating the first and the second piston.

In one aspect, each actuator comprises a motor dedicated for the first piston and a motor dedicated for the second piston.

In one aspect, the motor dedicated for the first piston is configured for actuating the first piston.

In one aspect, the motor dedicated for the second piston is configured for actuating the second piston.

In one aspect, each piston has an extension direction transverse to an extension direction of said at least one upright.

In one aspect, each seat has an extension direction transverse to an extension direction of said at least one upright.

In one aspect, the extendable structure comprises a single motor configured for actuating, selectively or simultaneously, the first piston and the second piston of the first actuator and the first piston and the second piston of the second actuator.

In one aspect, said motor comprises an electric motor.

In one aspect, said at least one actuator is of hydraulic or pneumatic type.

In one aspect, said at least one actuator is locally or remotely actuatable.

In one aspect, said at least one actuator is manually or automatically actuatable.

In one aspect, the extendable structure also comprises a control unit configured for implementing a sequence for moving actuators.

In one aspect, the extendable structure also comprises a timer operatively connected to the control unit, the sequence for moving actuators being scanned by the timer.

In one aspect, the control unit is configured for implementing at least the following sequence for moving actuators:

actuating said at least one actuator operatively connected to at least one from between the floor element and the ceiling element up to reaching the completely extended configuration of the extendable structure, following the attainment of the completely extended configuration of the extendable structure, actuating an actuator operatively connected to an additional wall hinged to said at least one lateral wall in a manner so as to determine a rotation of said at least one additional wall with respect to said at least one lateral wall around a hinge up to assuming a positioning orthogonal to said at least one lateral wall and defining a confinement wall of the extendable structure.

In one aspect, the extendable structure also comprises a control unit configured for simultaneously activating said actuators, optionally by means of a motor or a plurality of motors.

In one aspect, the foldable floor element comprises at least one first panel and one second panel hinged to each other, in the retracted configuration of the extendable structure the first panel and the second panel facing and substantially parallel to each other and being placed in proximity to said at least one upright, in a step of opening the extendable structure—aimed to determine the transition of the extendable structure from the retracted configuration to said at least one at least partially extended configuration—the first panel and the second panel rotating in a relative manner around a hinge at least partially away from said at least one upright, in a completely extended configuration of the extendable structure the first panel and the second panel being substantially coplanar and/or parallel to each other and orthogonal at least to the lower portion of said at least one upright.

In one aspect, the foldable ceiling element comprises at least one first panel and one second panel hinged to each other, in the retracted configuration of the extendable structure the first panel and the second panel facing and substantially parallel to each other and being placed in proximity to said at least one upright, in a step of opening the extendable structure—aimed to determine the transition of the extendable structure from the retracted configuration to said at least one at least partially extended configuration—the first panel and the second panel rotating in a relative manner around a hinge at least partially away from said at least one upright, in a completely extended configuration of the extendable structure the first panel and the second panel being substantially coplanar and/or parallel to each other and orthogonal at least to the upper portion of said at least one upright.

In one aspect, the box-like body also comprises at least one lateral wall, in the retracted configuration of the extendable structure said at least one lateral wall being placed in proximity to said at least one upright and laterally delimiting the box-like body, defining a side thereof, in said at least one at least partially extended configuration of the extendable structure said at least one lateral wall being spaced with respect to said at least one upright.

In one aspect, the floor element is hinged in proximity to or at a lower portion of said at least one lateral wall and the ceiling element is hinged in proximity to or at an upper portion of said at least one lateral wall, and in which in the opening step the spreading out of the ceiling element and/or of the floor element causes a moving away of said at least one lateral wall from said at least one upright, in a step of closing the extendable structure—aimed to determine the transition of the extendable structure from said at least one at least partially extended configuration or from a completely extended configuration to the retracted configuration—the folding of the ceiling element and/or of the floor element determining an approaching of said at least one lateral wall to said at least one upright.

In one aspect, the floor element comprises opposite ends respectively hinged at or in proximity to a lower portion of said at least one upright and at or in proximity to a lower portion of said at least one lateral wall.

In one aspect, the ceiling element comprises opposite ends respectively hinged at or in proximity to an upper portion of said at least one upright and at or in proximity to an upper portion of said at least one lateral wall.

In one aspect, in the step of opening the extendable structure said at least one lateral wall rigidly translates in moving away from said at least one upright.

In one aspect, in the step of closing the extendable structure said at least one lateral wall rigidly translates in approaching said at least one upright.

In one aspect, the extendable structure also comprises at least one element for aiding the movement.

In one aspect, said at least one element for aiding the movement is configured for at least partially facilitating the movement of the structure and/or of at least one portion thereof and/or of at least one wall or upright thereof.

In one aspect, said at least one element for aiding the movement is configured for facilitating the transition of the structure between the retracted and completely extended configurations and/or vice versa.

In one aspect, said at least one element for aiding the movement is configured for moving the structure in the completely extended configuration.

In one aspect, said at least one element for aiding the movement is engaged at or in proximity to a lower end of said at least one lateral wall, said at least one element for aiding the movement being configured for facilitating the movement of said at least one lateral wall in moving away from said at least one upright in the step of opening the extendable structure and in approaching said at least one upright in a step of closing the extendable structure—aimed to determine the transition of the extendable structure from said at least one at least partially extended configuration or from a completely extended configuration to the retracted configuration.

In one aspect, said at least one element for aiding the rotation is of rotating type.

In one aspect, said at least one element for aiding the rotation comprises a small wheel or a guide or a sled or a slide or an opening or a slidable portion.

In one aspect, the extendable structure also comprises at least one additional wall hinged to said at least one lateral wall, said at least one additional wall being configured for integrally translating with said at least one lateral wall during the step of opening the extendable structure, in the completely extended configuration of the extendable structure said at least one additional wall being configured for rotating with respect to said at least one lateral wall around a hinge up to assuming a positioning orthogonal to said at least one lateral wall and defining a confinement wall of the extendable structure.

In one aspect, the extendable structure also comprises a first additional wall and a second additional wall hinged in proximity to or at respective opposite sides of said at least one lateral wall, the first additional wall and the second additional wall being configured for integrally translating with said at least one lateral wall during the step of opening the extendable structure, in the completely extended configuration of the extendable structure the first additional wall and the second additional wall being configured for selectively rotating with respect to said at least one lateral wall around a respective hinge up to assuming a respective positioning orthogonal to said at least one lateral wall and defining respective confinement walls of the extendable structure, the confinement wall defined by the first additional wall being opposite the confinement wall defined by the second additional wall with reference to said at least one lateral wall.

In one aspect, in the completely extended configuration of the extendable structure, the first additional wall and the second additional wall are configured for selectively rotating with respect to the respective lateral wall to which they are hinged up to assuming a respective positioning orthogonal to the respective lateral wall and defining respective confinement walls of the extendable structure, the confinement wall defined by the first additional wall being opposite the confinement wall defined by the second additional wall with reference to the respective lateral wall.

In one aspect, the box-like body comprises a first lateral wall and a second lateral wall, in the retracted configuration of the extendable structure the first lateral wall and the second lateral wall being placed in proximity to said at least one upright and laterally delimiting the box-like body respectively defining opposite sides thereof, in said at least one at least partially extended configuration of the extendable structure the first lateral wall and the second lateral wall being spaced with respect to said at least one upright.

In one aspect, the floor element comprises a first foldable floor portion and a second foldable floor portion respectively engaged in proximity to opposite sides of the lower portion of said at least one upright, a lower portion of the first lateral wall being connected to one end of the first foldable floor portion and a lower portion of the second lateral wall being connected to one end of the second foldable floor portion.

In one aspect, the spreading out of the first foldable floor portion or of the second foldable floor portion causes a moving away respectively of the first lateral wall or of the second lateral wall from said at least one upright.

In one aspect, the folding of the first foldable floor portion or of the second foldable floor portion causes an approaching respectively of the first lateral wall or of the second lateral wall to said at least one upright.

In one aspect, the ceiling element comprises a first foldable ceiling portion and a second foldable ceiling portion respectively engaged in proximity to opposite sides of the upper portion of said at least one upright, an upper portion of the first lateral wall being connected to one end of the first foldable ceiling portion and an upper portion of the second lateral wall being connected to one end of the second foldable ceiling portion.

In one aspect, the spreading out of the first foldable ceiling portion or of the second foldable ceiling portion causes a moving away respectively of the first lateral wall or of the second lateral wall from said at least one upright.

In one aspect, the folding of the first foldable ceiling portion or of the second foldable ceiling portion causes an approaching respectively of the first lateral wall or of the second lateral wall to said at least one upright.

In one aspect, the extendable structure comprises a first pair of additional walls hinged in proximity to or at respective opposite sides of the first lateral wall and a second pair of additional walls hinged in proximity to or at respective opposite sides of the second lateral wall.

In one aspect, each pair of additional walls comprises a first additional wall and a second additional wall, the first additional wall and the second additional wall of each pair of additional walls being configured for integrally translating with the respective lateral wall during the step of opening the extendable structure, in the completely extended configuration of the extendable structure the first additional wall and the second additional wall of each pair of additional walls being configured for selectively rotating with respect to the respective lateral wall around a respective hinge up to assuming a respective positioning orthogonal to the respective lateral wall and defining respective confinement walls of the extendable structure, the confinement wall defined by the first additional wall being opposite the confinement wall defined by the second additional wall of a same pair of additional walls with reference to the respective lateral wall.

In one aspect, the box-like body comprises a first upright and a second upright substantially parallel to each other, the floor element being hinged to the first upright and to the second upright at respective lower portions of said first upright and second upright and the ceiling element being hinged to the first upright and to the second upright at respective upper portions of said first upright and second upright, a distance between the first upright and the second upright defining a depth of the box-like body, the distance between the first upright and the second upright being defined orthogonal to the first and/or second upright.

In one aspect, the depth of the box-like body is equal to the sum of a width of said at least one lateral wall and the thicknesses of the first upright and second upright.

In one aspect, by extendable structure it is intended a structure adapted to operate between a retracted configuration and at least one at least partially extended configuration, in which in said at least one at least partially extended configuration, the extendable structure has an internal volume suitable for housing one or more users and/or housing one or more furnishing elements.

In one aspect, by extendable structure it is intended a structure configured for being extended starting from a retracted configuration.

In one aspect, by extendable structure it is intended a structure configured for being extended, starting from a retracted configuration, transversely with respect to said at least one upright.

In one aspect, by extendable structure it is intended a structure configured for being extended, starting from a retracted configuration, orthogonally with respect to said at least one upright.

In one aspect, by extendable structure it is intended a structure configured for being extended, starting from a retracted configuration, horizontally with respect to an installation surface on which the extendable structure is intended to be set.

In one aspect, by extendable structure it is intended a structure configured for operating between a retracted configuration and a completely extended configuration, in the completely extended configuration the extendable structure having an extension at least equal to at least 3 or 4 or 5 or 6 times with respect to a width of the box-like body defined, in the retracted configuration of the extendable structure, by a width of said at least one upright.

In one aspect, the action of extending the extendable structure is caused by the spreading out of the floor element and of the ceiling element.

In one aspect, the structure is extendable along at least one direction.

In one aspect, said at least one extension direction is transverse or orthogonal to a main extension direction of said at least one upright.

In one aspect, said at least one extension direction is a horizontal direction, the horizontal direction being defined with reference to an operative configuration of the structure, such as the retracted configuration and/or the completely extended configuration of the structure.

In one aspect, the structure is extendable along two directions that are transverse to each other and transverse or orthogonal to a main extension direction of said at least one upright.

In one aspect, said two extension directions are orthogonal to each other and/or coplanar.

In one aspect, the extendable structure is also retractable.

In one aspect, the structure is retractable along said at least one structure extension direction.

In one aspect, the structure is configured for being at least partially spread out and/or folded along at least one extension or retraction extension.

In one aspect, by retractable structure it is intended a structure configured for being retracted starting from an at least partially extended configuration.

In one aspect, by retractable structure it is intended a structure configured for being retracted, starting from an at least partially extended configuration, transversely with respect to said at least one upright.

In one aspect, by retractable structure it is intended a structure configured for being retracted, starting from an at least partially extended configuration, orthogonally with respect to said at least one upright.

In one aspect, by retractable structure it is intended a structure configured for being extended, starting from an at least partially extended configuration, horizontally with respect to an installation surface on which the retractable structure is intended to be set.

In one aspect, the retraction of the extendable and retractable structure is caused by the folding of the floor element and of the ceiling element in approaching said at least one upright.

In one aspect, the width of said at least one upright is calculated as the distance between opposite sides of said at least one upright.

In one aspect, the structure is of at least partially foldable type.

In one aspect, by foldable floor element it is intended a floor element configured for being folded on itself.

In one aspect, by foldable floor element it is intended a floor element comprising at least one first panel and one second panel hinged to each other and configured for rotating around a hinge in a manner so as to determine the folding or the spreading out of the floor element.

In one aspect, by foldable ceiling element it is intended a ceiling element configured for being folded on itself.

In one aspect, by foldable ceiling element it is intended a ceiling element comprising at least one first panel and one second panel hinged to each other and configured for rotating around a hinge in a manner so as to determine the folding or the spreading out of the ceiling element.

In one aspect, the actions of folding and spreading out the floor element and the ceiling element are carried out in a main direction that is transverse with respect to said at least one upright.

In one aspect, the actions of folding and spreading out the floor element and the ceiling element are carried out in a main direction that is orthogonal with respect to said at least one upright.

In one aspect, the actions of folding and spreading out the floor element and the ceiling element are carried out in a main direction that is horizontal with respect to an installation surface on which the extendable structure is intended to be set.

In one aspect, in said at least one at least partially extended configuration, the extendable structure has a greater volume than a volume which the extendable structure has in the retracted configuration.

In one aspect, in the retracted configuration, the volume of the extendable structure is substantially defined by a volume of the box-like body.

In one aspect, the extendable structure has a cavity whose volume increases during the step of opening the extendable structure—aimed to determine the transition of the extendable structure from the retracted configuration to said at least one at least partially extended configuration.

In one aspect, the extendable structure has a cavity whose volume decreases during a step of closing the extendable structure—aimed to determine the transition of the extendable structure from said at least one at least partially extended configuration or from a completely extended configuration to the retracted configuration.

In one aspect, in the completely extended configuration the extendable structure has a volume whose size characteristics, such as height, depth and width, are adapted to house one or more users and/or to house furnishing elements.

In one aspect, the box-like body is configured for operating between a compact shape and an extended shape, in the retracted configuration of the extendable structure the box-like body assuming the compact shape, in a completely extended configuration of the extendable structure the box-like body assuming the extended shape.

In one aspect, the box-like body is a box-like body that can be opened or expanded.

In one aspect, by openable box-like body it is intended a box-like body configured for operating between a compact closed shape and an open or expanded shape, in the retracted configuration of the extendable structure the box-like body assuming the compact closed shape, in a completely extended configuration of the extendable structure the box-like body assuming the open or expanded shape.

In one aspect, the compact shape of the box-like body defines a configuration of the extendable structure with minimum size.

In one aspect, the box-like body is configured and/or structured for being opened, in the step of opening the extendable structure, substantially as a harmonica or bellows.

In one aspect, the floor element is configured and/or structured for being opened, in the step of opening the extendable structure, substantially as a harmonica or bellows.

In one aspect, the ceiling element is configured and/or structured for being opened, in the step of opening the extendable structure, substantially as a harmonica or bellows.

In one aspect, the box-like body comprises a first upright, a second upright opposite the first upright, a first lateral wall and a second lateral wall opposite the first lateral wall, the first lateral wall and the second lateral wall being opposite each other and defining, in the retracted configuration of the extendable structure, opposite sides of the box-like body.

In one aspect, the extendable structure comprises a frame.

In one aspect, the frame is made of metallic material.

In one aspect, the extendable structure comprises a plurality of panels engaged with the frame.

In one aspect, at least one of said walls or a plurality of said walls or each wall comprises at least one respective panel.

In one aspect, at least one of said walls or a plurality of said walls or each wall comprises at least one respective photovoltaic panel or module.

In one aspect, each photovoltaic panel comprises a photosensitive surface, each panel being suitably arranged in a manner such that the photosensitive surface is directed for receiving solar radiation.

In one aspect, at least one of said walls or a plurality of said walls or each wall comprises a frame or a frame portion.

In one aspect, at least one of said walls or a plurality of said walls or each wall comprises at least one panel engaged with the frame or with said frame portion.

In one aspect, at least one panel or a plurality of said panels or each panel has transparency properties.

In one aspect, at least one panel or a plurality of said panels or each panel is made of glassy material or of plastic or polymer material.

In one aspect, the first upright and the second upright are substantially parallel to each other.

In one aspect, the first lateral wall and the second lateral wall are substantially parallel to each other.

In one aspect, a distance between the first upright and the second upright defines, in the retracted condition of the extendable structure, a depth of the box-like body.

In one aspect, the distance between the first upright and the second upright is defined transverse or orthogonal to a main extension surface of the first upright and/or to a main extension surface of the second upright.

In one aspect, the distance between the first upright and the second upright is defined orthogonal to the first upright and/or to the second upright.

In one aspect, the depth of the box-like body defines, in the retracted configuration of the box-like body, the depth of the extendable structure.

In one aspect, a distance between the first lateral wall and the second lateral wall defines, in the retracted condition of the extendable structure, a width of the box-like body.

In one aspect, the distance between the first lateral wall and the second lateral wall is defined orthogonal to the first lateral wall and/or to the second lateral wall.

In one aspect, the width of said at least one upright is at least equal to 0.5 m (1.64 ft), in particular to 0.7 m (2.30 ft), still more particularly to 0.9 m (2.95 ft).

In one aspect, the width of said at least one upright defines, in the retracted configuration of the extendable structure, the width of the box-like body.

In one aspect, the width of the box-like body defines, in the retracted configuration of the box-like body, a width of the extendable structure.

In one aspect, the width of the box-like body is at least equal to 0.5 m (1.64 ft), in particular to 0.7 m (2.30 ft), still more particularly to 0.9 m (2.95 ft).

In one aspect, said at least one lateral wall has a width defining a depth of the box-like body and/or of the extendable structure.

In one aspect, the width of said at least one lateral wall is defined as the distance between sides of said at least one lateral wall, the distance between sides of said at least one lateral wall being defined transverse or orthogonal to said at least one upright.

In one aspect, the width of said at least one lateral wall is at least equal to 3 m (9.84 ft), in particular to 4 m (13.12 ft), still more particularly to 5 m (16.40 ft).

In one aspect, the width of said at least one lateral wall is substantially equal to 6 m (19.68 W.

In one aspect, the depth of the box-like body is greater than the width of the box-like body.

In one aspect, the depth of the box-like body is at least equal to double or three times the width of the box-like body.

In one aspect, the depth of the box-like body is at least equal to 3 m (9.84 ft), in particular to 4 m (13.12 ft), still more particularly to 5 m (16.40 ft).

In one aspect, the depth of the box-like body is substantially equal to 6 m (19.68 ft).

In one aspect, the depth of the box-like body defines, in the retracted configuration of the box-like body, a depth of the extendable structure.

In one aspect, the extendable structure has a same depth in the retracted configuration and in the completely extended configuration.

In one aspect, the extendable structure has a same depth in the retracted configuration, in said at least one at least partially extended configuration and in the completely extended configuration.

In one aspect, the depth of the extendable structure remains constant in a step of opening the extendable structure—aimed to determine the transition of the extendable structure from the retracted configuration to said at least one at least partially extended configuration or completely extended configuration.

In one aspect, the depth of the extendable structure remains constant in a step of closing the extendable structure—aimed to determine the transition of the extendable structure from said at least one at least partially extended configuration or from a completely extended configuration to the retracted configuration.

In one aspect, said at least one upright has opposite surfaces.

In one aspect, the opposite surfaces of said at least one upright are substantially planar and/or parallel to each other.

In one aspect, said at least one upright has a thickness defined as the distance between said surfaces of said at least one upright, the distance being defined orthogonal to at least one or to both the surfaces of said at least one upright.

In one aspect, said at least one upright has a thickness smaller than the width and height of said at least one upright.

In one aspect, the thickness of said at least one upright is at least one order of magnitude smaller than the height of said at least one upright.

In one aspect, the thickness of said at least one upright is smaller than half the width of said at least one upright.

In one aspect, the thickness of said at least one upright is transverse or orthogonal with respect to the width and to the height of said at least one upright.

In one aspect, the first upright has an upper portion and a lower portion, a distance between one end of the upper portion and one end of the lower portion defining a height of the box-like body.

In one aspect, the height of the box-like body is defined along a main extension direction of the first upright.

In one aspect, the second upright has an upper portion and a lower portion, a distance between one end of the upper portion and one end of the lower portion defining a height of the box-like body.

In one aspect, the height of the box-like body is defined along a main extension direction of the second upright.

In one aspect, the first upright has a height equal to a height of the second upright.

In one aspect, the height of said at least one upright is at least equal to 1.5 m, in particular to 2 m, still more particularly to 2.5 m.

In one aspect, the height of said at least one upright is substantially equal to 2.8 m (9.19 ft).

In one aspect, the height of said at least one upright is substantially equal to the height of said at least one lateral wall.

In one aspect, said at least one lateral wall has one upper end and one lower end, the height of said at least one lateral wall being defined as the distance between the upper end and the lower end.

In one aspect, the height of said at least one lateral wall is of a same order of magnitude as the height of said at least one upright.

In one aspect, the height of said at least one lateral wall is at least equal to 1.5 m (4.92 ft), in particular to 2 m (6.56 ft), still more particularly to 2.5 m (8.20 ft).

In one aspect, the height of said at least one lateral wall is substantially equal to 2.8 m (9.19 W.

In one aspect, the height of said at least one lateral wall is smaller than the width of said at least one lateral wall.

In one aspect, the height of said at least one lateral wall is greater than the width of said at least one lateral wall.

In one aspect, the height of said at least one lateral wall is substantially equal to the width of said at least one lateral wall.

In one aspect, said at least one lateral wall has opposite surfaces.

In one aspect, the opposite surfaces of said at least one lateral wall are substantially planar and/or parallel to each other.

In one aspect, said at least one lateral wall has a thickness defined as the distance between said surfaces of said at least one lateral wall, the distance being defined orthogonal to at least one or to both the surfaces of said at least one lateral wall.

In one aspect, said at least one lateral wall has a thickness smaller than the width and of the height of said at least one lateral wall.

In one aspect, the thickness of said at least one lateral wall is at least one order of magnitude smaller than the height of said at least one lateral wall.

In one aspect, the thickness of said at least one lateral wall is at least one order of magnitude smaller than the width of said at least one lateral wall.

In one aspect, the thickness of said at least one lateral wall is smaller than half the width of said at least one lateral wall.

In one aspect, the thickness of said at least one lateral wall is transverse or orthogonal with respect to the width and to the height of said at least one lateral wall.

In one aspect, the thickness of said at least one lateral wall is substantially equal to and/or analogous to and/or comparable to and/or corresponding to and/or of the same order of magnitude as and/or correlated to the thickness of said at least one upright.

In one aspect, the first lateral wall has one upper end and one lower end, a distance between the upper end and the lower end defining a height of the box-like body.

In one aspect, the second lateral wall has one upper end and one lower end, a distance between the upper end and the lower end defining a height of the box-like body.

In one aspect, the first lateral wall has a height equal to a height of the second lateral wall.

In one aspect, the height of said at least one upright defines the height of the box-like body and/or of the extendable structure.

In one aspect, the height of the box-like body is at least equal to 1.5 m (4.92 ft), in particular to 2 m (6.56 ft), still more particularly to 2.5 m (8.20 ft).

In one aspect, the height of the box-like body is substantially equal to 2.8 m (9.19 ft).

In one aspect, the height of the box-like body defines, in the retracted configuration of the box-like body, a height of the extendable structure.

In one aspect, the extendable structure has a same height in the retracted configuration and in the completely extended configuration.

In one aspect, the extendable structure has a same height in the retracted configuration, in said at least one at least partially extended configuration and in the completely extended configuration.

In one aspect, the height of the extendable structure remains constant in a step of opening the extendable structure—aimed to determine the transition of the extendable structure from the retracted configuration to said at least one at least partially extended configuration or completely extended configuration.

In one aspect, the height of the extendable structure remains constant in a step of closing the extendable structure—aimed to determine the transition of the extendable structure from said at least one at least partially extended configuration or from a completely extended configuration to the retracted configuration.

In one aspect, the extendable structure has a same height in the retracted configuration and in the completely extended configuration.

In one aspect, the extendable structure has a different extension in the retracted configuration, in said at least one at least partially extended configuration and in the completely extended configuration.

In one aspect, in the opening step the extendable structure has an intermediate extension comprised between an extension of the extendable structure in the retracted configuration and an extension of the extendable structure in the completely extended configuration.

In one aspect, in the completely extended configuration, the extendable structure has an extension greater than an extension which the extendable structure has in the retracted configuration.

In one aspect, in the completely extended configuration the extendable structure has a maximum extension.

In one aspect, the extension of the extendable structure increases in a step of opening the extendable structure—aimed to determine the transition of the extendable structure from the retracted configuration to said at least one at least partially extended configuration or completely extended configuration.

In one aspect, the extension of the extendable structure decreases in a step of closing the extendable structure—aimed to determine the transition of the extendable structure from said at least one at least partially extended configuration or from a completely extended configuration to the retracted configuration.

In one aspect, in the completely extended configuration the extendable structure has an extension at least equal to at least 3 or 4 or 5 or 6 times with respect to a width of the box-like body defined, in the retracted configuration of the extendable structure, by a width of said at least one upright.

In one aspect, in the completely extended configuration the extendable structure has an extension at least equal to 3 m (9.84 ft) or 4 m (13.12 ft) or to 5 m (16.40 ft) or to 6 m (19.68 ft).

In one aspect, said at least one lateral wall comprises a slidable portion and a static portion, the slidable portion being configured for sliding with respect to the static portion in a manner such to define a gap at said at least one lateral wall.

In one aspect, said at least one lateral wall comprises a guide configured for allowing the sliding of the slidable portion with respect to the static portion.

In one aspect, in the completely extended configuration of the extendable structure, the gap defined at said at least one lateral wall is intended for and/or sized for allowing, for example for allowing a user user, to enter into the extendable structure and exit from the extendable structure.

In one aspect, the gap defined at said at least one lateral wall has a height at least equal to 1.7 m (5.58 ft) or to 1.85 m (6.07 ft) or to 2 m (6.56 ft).

In one aspect, the gap defined at said at least one lateral wall has a width at least equal to 0.5 m (1.64 ft) or to 0.75 m (2.46 ft) or to 1 m (3.28 ft).

In one aspect, said at least one additional wall comprises a slidable portion and a static portion, the slidable portion being configured for sliding with respect to the static portion in a manner such to define a gap at said at least one additional wall.

In one aspect, said at least one additional wall comprises a guide configured for allowing the sliding of the slidable portion with respect to the static portion.

In one aspect, said at least one additional wall is of telescopic type.

In one aspect, the additional wall of telescopic type comprises an extractible portion and a housing portion configured for housing the extractible portion, the extractible portion being configured for being extracted from the housing portion.

In one aspect, the extractible portion is configured for sliding with respect to the housing portion in a manner such to define a gap at said at least one additional wall.

In one aspect, in the completely extended configuration of the extendable structure, the gap defined at said at least one additional wall is intended for and/or sized for allowing, for example for allowing a user to enter into the extendable structure or exit from the extendable structure.

In one aspect, the gap defined at said at least one additional wall has a height at least equal to 1.7 m (5.58 ft) or to 1.85 m (6.07 ft) or to 2 m (6.56 ft).

In one aspect, the gap defined at said at least one additional wall has a width at least equal to 0.5 m (1.64 ft) or to 0.75 m (2.46 ft) or to 1 m (3.28 ft).

In one aspect, the foldable floor element comprises at least one first panel and one second panel hinged to each other, in the retracted configuration of the extendable structure the first panel and the second panel facing and substantially parallel to each other and being placed in proximity to a lower portion of said at least one upright, in a step of opening the extendable structure—aimed to determine the transition of the extendable structure from the retracted configuration to said at least one at least partially extended configuration—the first panel and the second panel rotating in a relative manner around a hinge at least partially away from said at least one upright, in a completely extended configuration of the extendable structure the first panel and the second panel being substantially coplanar and/or parallel to each other and orthogonal at least to the lower portion of said at least one upright.

In one aspect, the foldable ceiling element comprises at least one first panel and a second panel hinged to each other, in the retracted configuration of the extendable structure the first panel and the second panel facing and substantially parallel to each other and being placed in proximity to an upper portion of said at least one upright, in a step of opening the extendable structure—aimed to determine the transition of the extendable structure from the retracted configuration to said at least one at least partially extended configuration—the first panel and the second panel rotating in a relative manner around a hinge at least partially away from said at least one upright, in a completely extended configuration of the extendable structure the first panel and the second panel being substantially coplanar and/or parallel to each other and orthogonal at least to the upper portion of said at least one upright.

In one aspect, in the opening step and in the closing step, the foldable ceiling element defining a cusp at the hinge, in particular astride the hinge.

In one aspect, the extendable structure also comprising a sheath arranged at a respective portion of external surfaces of the first panel and of the second panel, said portion being placed in proximity to the hinge, the sheath being configured for preventing the entrance of weather phenomena, such as rain and/or wind, or of fluids or solid material from outside the extendable structure to the interior of a volume defined by the extendable structure.

In one aspect, the sheath comprises flaps configured for being opened in the step of opening the extendable structure.

In one aspect, the sheath comprises flaps configured for moving close together in a step of closing the extendable structure—aimed to determine the transition of the extendable structure from said at least one at least partially extended configuration or from a completely extended configuration to the retracted configuration.

In one aspect, the sheath is engaged to the panels at the cusp, in particular above and astride with respect to the cusp.

In one aspect, in the retracted configuration of the extendable structure, the sheath has a substantially U-shaped conformation.

In one aspect, in the step of opening or closing the extendable structure, the sheath has a substantially V-shaped conformation.

In one aspect, in the completely extended configuration of the extendable structure, the sheath has a conformation that is mainly or substantially flat.

In one aspect, in the completely extended configuration of the extendable structure, the flaps of the sheath are substantially coplanar.

In one aspect, the sheath is flexible or foldable.

In one aspect, the sheath is elastically deformable.

In one aspect, the sheath is removable and/or replaceable.

In one aspect, the extendable structure is of modular type.

In one aspect, the extendable structure of modular type comprises at least one first and one second module, the first module being engaged in proximity to or at said at least one upright, the second module being engaged with the first module on the opposite side with respect to said at least one upright.

In one aspect, the extendable structure comprises a dividing wall arranged between the first module and the second module the structure.

In one aspect, the dividing wall has a gap intended for and/or sized for allowing, for example for allowing a user, to enter into the extendable structure or to exit from the extendable structure.

In one aspect, the gap defined at said dividing wall has a height at least equal to 1.7 m (5.58 W or to 1.85 m (6.07 ft) or to 2 m (6.56 ft).

In one aspect, the gap defined at said dividing wall has a width at least equal to 0.5 m (1.64 W or to 0.75 m (2.46 ft) or to 1 m (3.28 ft).

In one aspect, the second module is interposed between the lateral wall and the first module and is engaged with a lateral wall of the box-like body and, by means of the dividing wall, with the first module.

In one aspect, in the completely extended configuration of the extendable structure, each module substantially defines a space of the extendable structure.

In one aspect, the extendable structure of modular type comprises at least one first pair of modules and at least one second pair of modules, each pair of modules having a first module, a second module and a dividing wall interposed between the first module and the second module.

In one aspect, the pairs of modules are arranged at opposite sides of said at least one upright.

In one aspect, each first module is engaged in proximity to or at a respective side of said at least one upright, the sides of said at least one upright to which the first modules are engaged being opposite each other.

In one aspect, each second module is engaged with the respective first module on the opposite side with respect to a respective side of said at least one upright.

In one aspect, the second module of the first pair of modules is engaged with a first lateral wall of the box-like body.

In one aspect, the second module of the second pair of modules is engaged with a second lateral wall of the box-like body.

In one aspect, each module has a floor portion and a ceiling portion.

In one aspect, in the completely extended configuration the extendable structure of modular type has an extension at least equal to at least 3 or 4 or 5 or 6 times with respect to a width of the box-like body defined, in the retracted configuration of the extendable structure of modular type, by a width of said at least one upright.

In one aspect, the foldable floor element is extractible from a volume defined by the box-like body in the retracted configuration of the extendable structure.

In one aspect, the foldable ceiling element is extractible from a volume defined by the box-like body in the retracted configuration of the extendable structure.

In one aspect, the foldable floor element is insertable in a volume defined, in said at least one at least partially extended configuration or completely extended configuration of the extendable structure, between the first upright and the second upright of the extendable structure.

In one aspect, the foldable ceiling element is insertable in a volume defined, in said at least one at least partially extended configuration or completely extended configuration of the extendable structure, between the first upright and the second upright of the extendable structure.

In one aspect, the foldable floor element is of concealable type, in the retracted configuration of the extendable structure being completely housed within the box-like body.

In one aspect, the foldable ceiling element is of concealable type, in the retracted configuration of the extendable structure being completely housed within the box-like body.

In one aspect, the floor element is configured and/or structured for supporting loads such as the weight of one or more users and/or the weight of at least one furnishing element.

In one aspect, the extendable structure comprises at least one intermediate foldable element hinged in proximity to or at an intermediate portion of said at least one upright interposed between the lower portion and the upper portion of said at least one upright, in the retracted configuration of the extendable structure said at least one intermediate element being folded and being placed in proximity to said at least one upright, in a step of opening the extendable structure—aimed to determine the transition of the extendable structure from the retracted configuration to said at least one at least partially extended configuration—said at least one intermediate element being transversely spread out and at least partially away from said at least one upright, in a completely extended configuration of the extendable configuration said at least one intermediate element being interposed between the floor element and the ceiling element and being substantially flat and transverse to said at least one upright.

In one aspect, the extendable structure is extended on at least two levels.

In one aspect, the extendable structure is extended on a first level and on a second level, the second level being arranged at a different height with respect to the first level.

In one aspect, the second level is arranged at a height greater than the first level.

In one aspect, the first level is defined between the foldable floor element and said at least one intermediate foldable element and the second level is defined between said at least one intermediate foldable element and the foldable ceiling element.

In one aspect, said at least one intermediate element has a lower surface and an upper surface that are mutually opposite, the lower surface and the upper surface being defined with reference to a configuration spread out that said at least one intermediate element assumes in the completely extended configuration of the extendable structure, the lower surface of said at least one intermediate element acting as a ceiling for the first level and the upper surface of said at least one intermediate element acting as a floor for the second level.

In one aspect, the intermediate portion of said at least one upright is a middle portion of said at least one upright, the middle portion of said at least one upright being defined with reference to a main extension direction of said at least one upright.

In one aspect, the extendable structure is of compact type.

In one aspect, the structure is a prefabricated structure.

In one aspect, in the completely extended configuration, the extendable structure is self-supporting.

In one aspect, the extendable structure is configured for operating in the completely extended configuration without the aid of support elements outside the extendable structure.

In one aspect, the extendable structure lacks a pitched roof.

In one aspect, the extendable structure comprises a power supply source configured for power supplying said at least one actuator, the power supply source being housed within the box-like body in the retracted configuration of the structure.

In one aspect, the power supply source is a battery.

In one aspect, the extendable structure is configured for being open and/or closed in the absence of power supply sources.

In one aspect, the extendable structure comprises at least one electric motor operatively connected to the floor element and/or to the ceiling element and configured for folding and/or spreading out the floor element and/or the ceiling element, the power supply source being an electrical battery, the electrical battery being connected to said at least one electric motor and being configured for power supplying said at least one electric motor.

In one aspect, the extendable structure is configured for being open and/or closed in the absence of power supply sources outside the structure.

In one aspect, the extendable structure is transportable in the retracted configuration.

In one aspect, the extendable structure is temporarily installable outside or in an indoor location.

In one aspect, in the retracted configuration, the extendable structure can be stacked with further structures.

In one aspect, in the completely extended configuration, the extendable structure can be side by side further structures.

In a second independent aspect, the invention relates to a use of the extendable structure as temporary set-up, for example outdoors or indoors.

In one aspect, it is provided to use the extendable structure as display space and/or information space, e.g. outdoors or indoors.

In a third independent aspect, the invention relates to a method for moving an extendable structure comprising at least the following steps:

arranging an extendable structure adapted to operate between a retracted configuration and at least one at least partially extended configuration and comprising:
- a box-like body comprising at least one upright, in the retracted configuration of the extendable structure the box-like body defining an overall size of the extendable structure,
- a foldable floor element hinged in proximity to or at a lower portion of said at least one upright, and
- a foldable ceiling element hinged in proximity to or at an upper portion of said at least one upright, in the retracted configuration of the extendable structure the floor element and the ceiling element being housed within the box-like body, spreading out the foldable floor element in a manner so as to determine a transition of the extendable structure from the retracted configuration to said at least one at least partially extended configuration or folding the foldable floor element in a manner so as to determine a transition of the extendable structure from said at least one at least partially extended configuration to the retracted configuration, and/or spreading out the foldable ceiling element in a manner so as to determine a transition of the extendable structure from the retracted configuration to said at least one at least partially extended configuration or folding the foldable ceiling element in a manner so as to determine a transition of the extendable structure from said at least one at least partially extended configuration to the retracted configuration.

In one aspect, the method for moving an extendable structure is a method for actuating an extendable structure.

In one aspect, the method for actuating an extendable structure provides for spreading out or folding the floor element and/or the ceiling element by means of at least one actuator.

In one aspect, the steps of spreading out or folding the floor element are attained by means of an actuator.

In one aspect, the steps of spreading out or folding the ceiling element are attained by means of an actuator.

In one aspect, the steps of spreading out or folding the ceiling element and the steps of spreading out or folding the floor element are attained by means of a same actuator.

In one aspect, the steps of spreading out or folding the floor element are attained by means of a first actuator.

In one aspect, the steps of spreading out or folding the ceiling element are attained by means of a second actuator.

In one aspect, the method for moving an extendable structure is a method for setting up an extendable structure.

In one aspect, the method for setting up an extendable structure provides for the transition of the extendable structure from the retracted configuration to the completely extended configuration.

In one aspect, the method for setting up an extendable structure comprises the following steps:

arranging an extendable structure adapted to operate between a retracted configuration and at least one at least partially extended configuration and comprising:
- a box-like body comprising at least one upright, in the retracted configuration of the extendable structure the box-like body defining an overall size of the extendable structure,
- a foldable floor element hinged in proximity to or at a lower portion of said at least one upright, and
- a foldable ceiling element hinged in proximity to or at an upper portion of said at least one upright, in the retracted configuration of the extendable structure the floor element and the ceiling element being housed within the box-like body, spreading out the foldable floor element in a manner so as to determine a transition of the extendable structure from the retracted configuration to said at least one at least partially extended configuration or completely extended configuration, and/or spreading out the foldable ceiling element in a manner so as to determine a transition of the extendable structure from the retracted configuration to said at least one at least partially extended configuration.

In one aspect, the method for setting up an extendable structure is attained in a manner that is at least partially automatic or semi-automatic or automatized or semi-automatized.

In one aspect, the method for moving an extendable structure is a method for retracting or dismantling an extendable structure.

In one aspect, the method for retracting or dismantling an extendable structure is made in a manner that is at least partially automatic or semi-automatic or automatized or semi-automatized.

In one aspect, arranging an extendable structure comprises arranging an extendable and retractable structure.

In one aspect, the method for retracting an extendable and retractable structure provides for the transition of the extendable and retractable structure from the completely extended configuration to the retracted configuration.

In one aspect, the method for retracting an extendable structure comprises the following steps:

arranging an extendable structure adapted to operate between a retracted configuration and at least one at least partially extended configuration and comprising:
- a box-like body comprising at least one upright, in the retracted configuration of the extendable structure the box-like body defining an overall size of the extendable structure,
- a foldable floor element hinged in proximity to or at a lower portion of said at least one upright, and
- a foldable ceiling element hinged in proximity to or at an upper portion of said at least one upright, in the retracted configuration of the extendable structure the floor element and the ceiling element being housed within the box-like body, folding the foldable floor element in a manner so as to determine a transition of the extendable structure from said at least one at least partially extended configuration or from a completely extended configuration to the retracted configuration, and/or folding the foldable ceiling element in a manner so as to determine a transition of the extendable structure from said at least one at least partially extended configuration to the retracted configuration.

In one aspect, the step of spreading out or folding the foldable ceiling element and the step of spreading out or folding the foldable floor element are attained in a manner so as to move the ceiling element and the floor element in a mirrored manner with respect to a plane crossing through a center line of said at least one upright orthogonal to a main extension direction of said at least one upright, the center line being defined with reference to the main extension direction of said at least one upright.

In one aspect:

the step of arranging an extendable structure comprises arranging an extendable structure in which the ceiling element comprises a first foldable ceiling portion and a second foldable ceiling portion extending at opposite sides of said at least one upright and the floor element comprises a first foldable floor portion and a second foldable floor portion extending at opposite sides of said at least one upright, the step of spreading out or folding the foldable ceiling element is attained in a manner so as to move the first foldable ceiling portion and the second foldable ceiling portion in a mirrored manner with respect to a plane crossing through said at least one upright parallel to a main extension direction of said at least one upright, and/or the step of spreading out or folding the foldable floor element is attained in a manner so as to move the first foldable floor portion and the second foldable floor portion in a mirrored manner with respect to a plane crossing through said at least one upright parallel to a main extension direction of said at least one upright.

In one aspect, the step of spreading out or folding the foldable ceiling element and the step of spreading out or folding the foldable floor element are simultaneous.

In one aspect, the step of spreading out the foldable ceiling element and the step of spreading out the foldable floor element are attained in a manner so as to position the ceiling element and the floor element parallel to each other in a completely extended configuration of the extendable structure.

In one aspect, arranging an extendable structure comprises arranging an extendable structure also comprising at least one lateral wall, in the retracted configuration of the extendable structure said at least one lateral wall being placed in proximity to said at least one upright and laterally delimiting the box-like body, defining one side thereof, the method also comprising a step of rigidly translating said at least one lateral wall.

In one aspect, the step of spreading out or folding the floor element causes the rigid translation of said at least one lateral wall.

In one aspect, the step of spreading out the floor element causes the rigid translation of said at least one lateral wall in moving away from said at least one upright.

In one aspect, the step of folding the floor element causes the rigid translation of said at least one lateral wall in approaching said at least one upright.

In one aspect, the step of spreading out or folding the floor element is carried out simultaneously with the step of rigidly translating said at least one lateral wall.

In one aspect, the step of spreading out or folding the ceiling element causes the rigid translation of said at least one lateral wall.

In one aspect, the step of spreading out the ceiling element causes the rigid translation of said at least one lateral wall in moving away from said at least one upright.

In one aspect, the step of folding the ceiling element causes the rigid translation of said at least one lateral wall in approaching said at least one upright.

In one aspect, the step of spreading out or folding the ceiling element is carried out simultaneously with the step of rigidly translating said at least one lateral wall.

In one aspect:

arranging an extendable structure comprises arranging an extendable structure also comprising at least one additional wall hinged to said at least one lateral wall, spreading out the foldable floor element in a manner so as to determine a transition of the extendable structure from the retracted configuration to said at least one at least partially extended configuration comprises spreading out the foldable floor element in a manner so as to determine a transition of the extendable structure from the retracted configuration to the completely extended configuration, and/or spreading out the foldable ceiling element in a manner so as to determine a transition of the extendable structure from the retracted configuration to said at least one at least partially extended configuration comprises spreading out the foldable ceiling element in a manner so as to determine a transition of the extendable structure from the retracted configuration to the completely extended configuration, the method also comprising the steps of:

translating said at least one additional wall integral with said at least one lateral wall up to reaching the completely extended configuration of the extendable structure, following the attainment of the completely extended configuration of the extendable structure, rotating said at least one additional wall with respect to said at least one lateral wall around a hinge up to assuming a positioning orthogonal to said at least one lateral wall and define a confinement wall of the extendable structure.

In one aspect:

arranging an extendable structure comprises arranging an extendable structure also comprising a first additional wall and a second additional wall hinged in proximity to or at respective opposite sides of said at least one lateral wall, spreading out the foldable floor element in a manner so as to determine a transition of the extendable structure from the retracted configuration to said at least one at least partially extended configuration comprises spreading out the foldable floor element in a manner so as to determine a transition of the extendable structure from the retracted configuration to the completely extended configuration, and/or spreading out the foldable ceiling element in a manner so as to determine a transition of the extendable structure from the retracted configuration to said at least one at least partially extended configuration comprises spreading out the foldable ceiling element in a manner so as to determine a transition of the extendable structure from the retracted configuration to the completely extended configuration, the method also comprising the steps of:

translating the first additional wall and the second additional wall integral with said at least one lateral wall up to reaching the completely extended configuration of the extendable structure, following the attainment of the completely extended configuration of the extendable structure, selectively rotating the first additional wall and the second additional wall with respect to said at least one lateral wall around a respective hinge up to assuming a respective positioning orthogonal to said at least one lateral wall and defining respective confinement walls of the extendable structure, the confinement wall defined by the first additional wall being opposite the confinement wall defined by the second additional wall with reference to said at least one lateral wall.

In one aspect:

arranging an extendable structure comprises arranging an extendable structure comprising:

a box-like body also comprising a first lateral wall and a second lateral wall, in the retracted configuration of the extendable structure the first lateral wall and the second lateral wall being placed in proximity to said at least one upright and laterally delimiting the box-like body, respectively defining opposite sides thereof, in said at least one at least partially extended configuration of the extendable structure the first lateral wall and the second lateral wall being spaced with respect to said at least one upright, a first pair of additional walls hinged in proximity to or at respective opposite sides of the first lateral wall and a second pair of additional walls hinged in proximity to or at respective opposite sides of the second lateral wall, each pair of additional walls comprising a first additional wall and a second additional wall, the first additional wall and the second additional wall of each pair of additional walls being configured for integrally translating with the respective lateral wall during the step of opening the extendable structure, spreading out the foldable floor element in a manner so as to determine a transition of the extendable structure from the retracted configuration to said at least one at least partially extended configuration comprises spreading out the foldable floor element in a manner so as to determine a transition of the extendable structure from the retracted configuration to the completely extended configuration, and/or spreading out the foldable ceiling element in a manner so as to determine a transition of the extendable structure from the retracted configuration to said at least one at least partially extended configuration comprises spreading out the foldable ceiling element in a manner so as to determine a transition of the extendable structure from the retracted configuration to the completely extended configuration, the method also comprising the steps of:

translating the pairs of additional walls integrally with the respective lateral wall to which they are respectively hinged up to reaching the completely extended configuration of the extendable structure, following the attainment of the completely extended configuration of the extendable structure, selectively rotating the first additional wall and the second additional wall of each pair of additional walls with respect to the respective lateral wall around a respective hinge up to assuming a respective positioning orthogonal to the respective lateral wall and defining respective confinement walls of the extendable structure, the confinement wall defined by the first additional wall being opposite the confinement wall defined by the second additional wall of a same pair of additional walls with reference to the respective lateral wall.

In one aspect, the step of rotating said at least one additional wall with respect to said at least one lateral wall around a hinge up to assuming a positioning orthogonal to said at least one lateral wall and defining a confinement wall of the extendable structure is attained manually.

In one aspect, the step of rotating said at least one additional wall with respect to said at least one lateral wall around a hinge up to assuming a positioning orthogonal to said at least one lateral wall and defining a confinement wall of the extendable structure is attained by means of an actuator.

In one aspect, the step of translating said at least one additional wall integral with said at least one lateral wall is carried out simultaneously with the step of spreading out or folding the floor element.

In one aspect, the step of translating said at least one additional wall integral with said at least one lateral wall is carried out simultaneously with the step of rigidly translating said at least one lateral wall.

In one aspect, translating said at least one additional wall integral with said at least one lateral wall up to reaching the completely extended configuration of the extendable structure comprises rigidly translating said at least one additional wall integral with said at least one lateral wall up to reaching the completely extended configuration of the extendable structure. In one aspect, the step of spreading out or folding the ceiling element causes the rigid translation of said at least one additional wall. In one aspect, the step of spreading out the ceiling element causes the rigid translation of said at least one additional wall in moving away from said at least one upright. In one aspect, the step of folding the ceiling element causes the rigid translation of said at least one additional wall in approaching said at least one upright.

In one aspect, in which arranging an extendable structure comprises arranging an extendable structure comprising at least one element for aiding the movement engaged at or in proximity to a lower portion of a lateral wall of the extendable structure, the method also comprising the step of moving said at least one lateral wall in approaching said at least one upright or in moving away from said at least one upright by means of said at least one element for aiding the movement.

BRIEF DESCRIPTION OF THE FIGURES

The present description will now be set forth hereinbelow with reference to the enclosed drawings, provided only as a non-limiting example, in which:

FIG. 5 also shows a detail of a sheath, FIG. 6 also shows a detail of a sheath, FIG. 7 also shows a detail of a sheath.

DETAILED DESCRIPTION

With reference to the figures, reference number 1 overall indicates a structure in accordance with the invention.

In the context of the present description, the use of terms such as "upper", "above/on the upper part", "lower", "below/on the lower part", "lateral", "laterally", "horizontal", "horizontally", "vertical", "vertically", "front", "frontally", "rear", "on the rear part" and the like refer—save for different specific indications—to the spatial orientation that the extendable structure 1 can normally assume in operative or use conditions. On such matter, see the enclosed figures.

Figure 1:
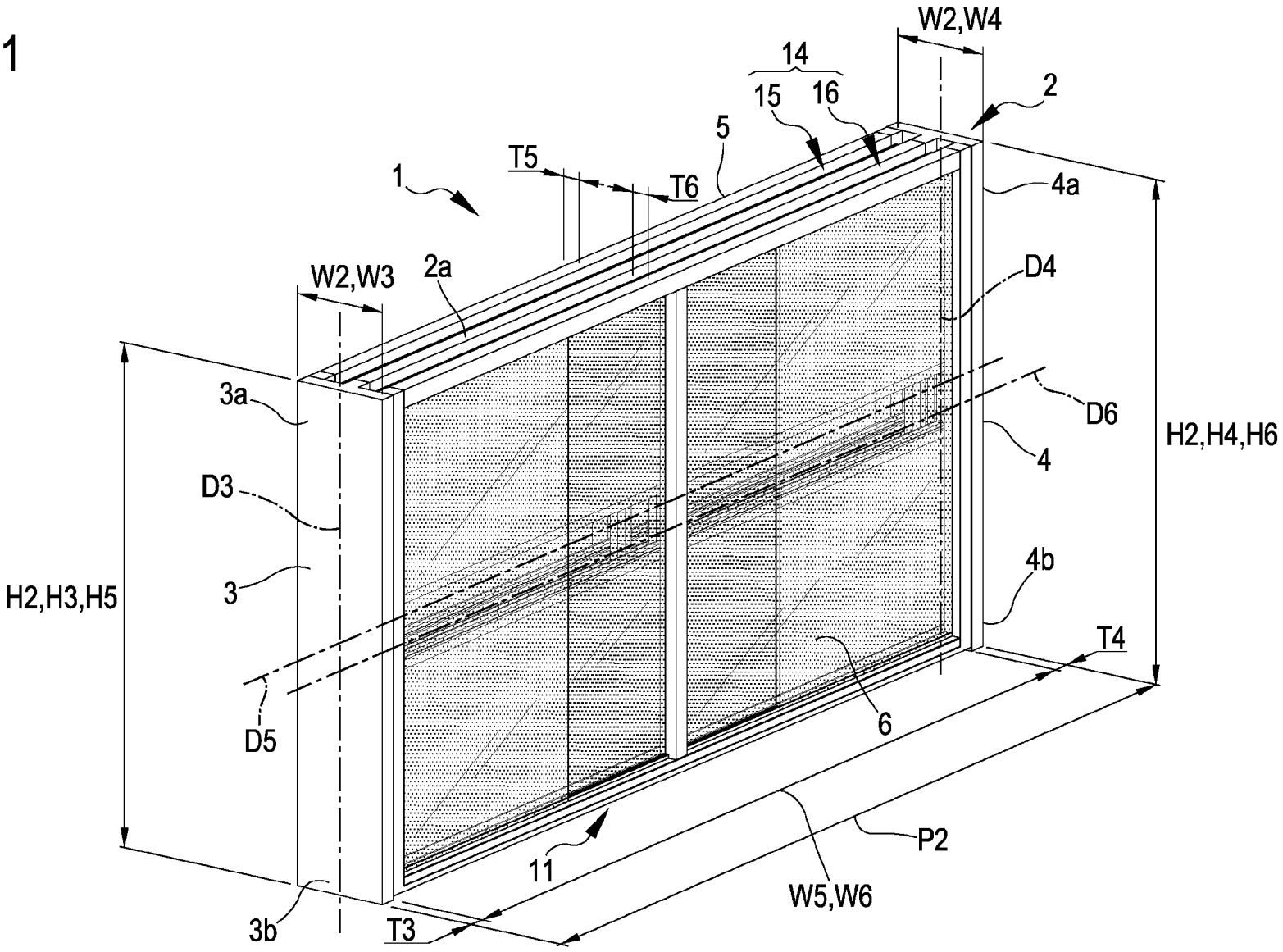
FIG. 1 represents an extendable structure in accordance with an exemplifying embodiment of the present description in a retracted configuration.
Figure 2:
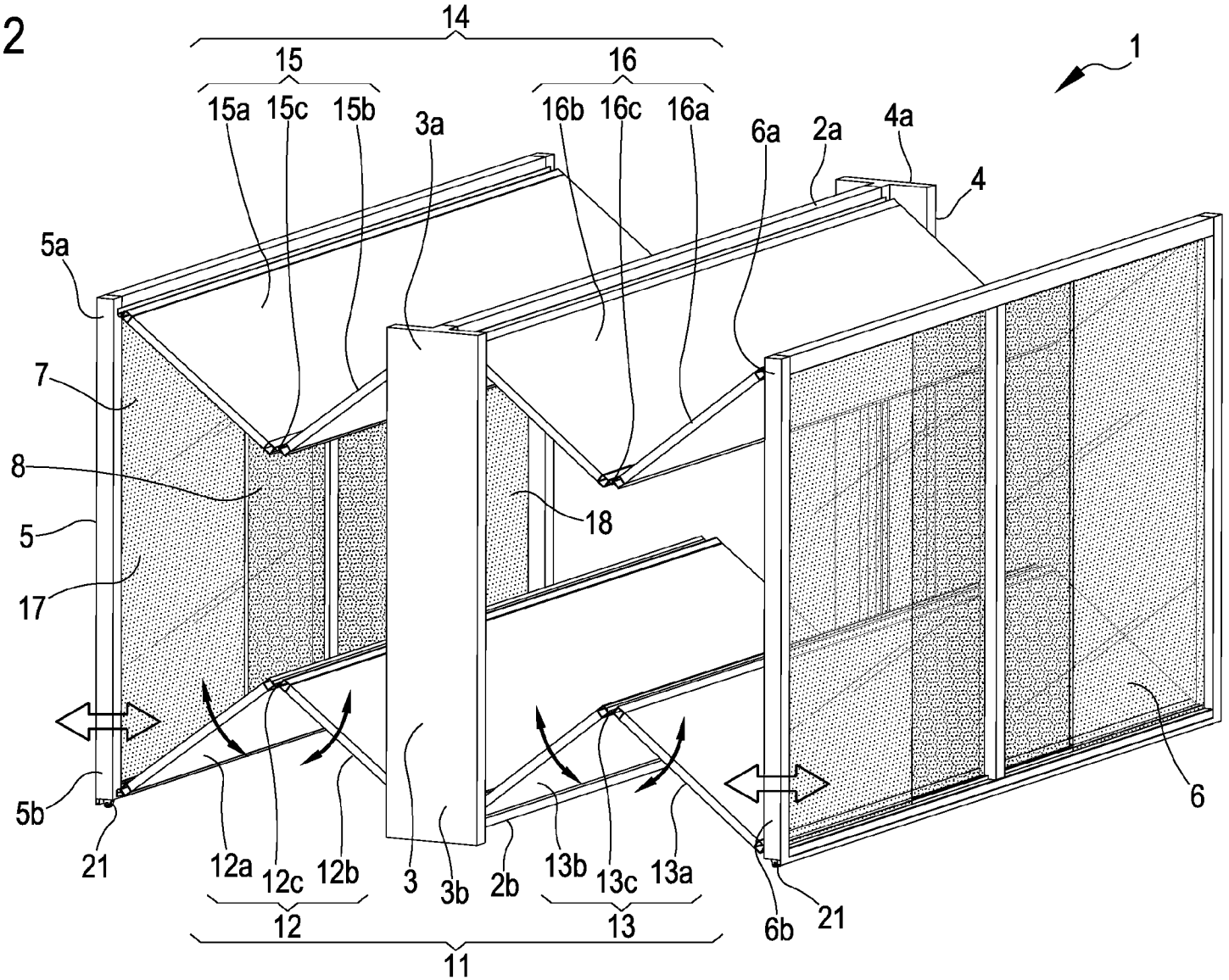
FIG. 2 represents the extendable structure of FIG. 1 in an opening step in which the structure takes on a partially extended configuration, intermediate between the retracted configuration and a completely extended configuration, in which the floor element and the ceiling element are folded.
Figure 3:
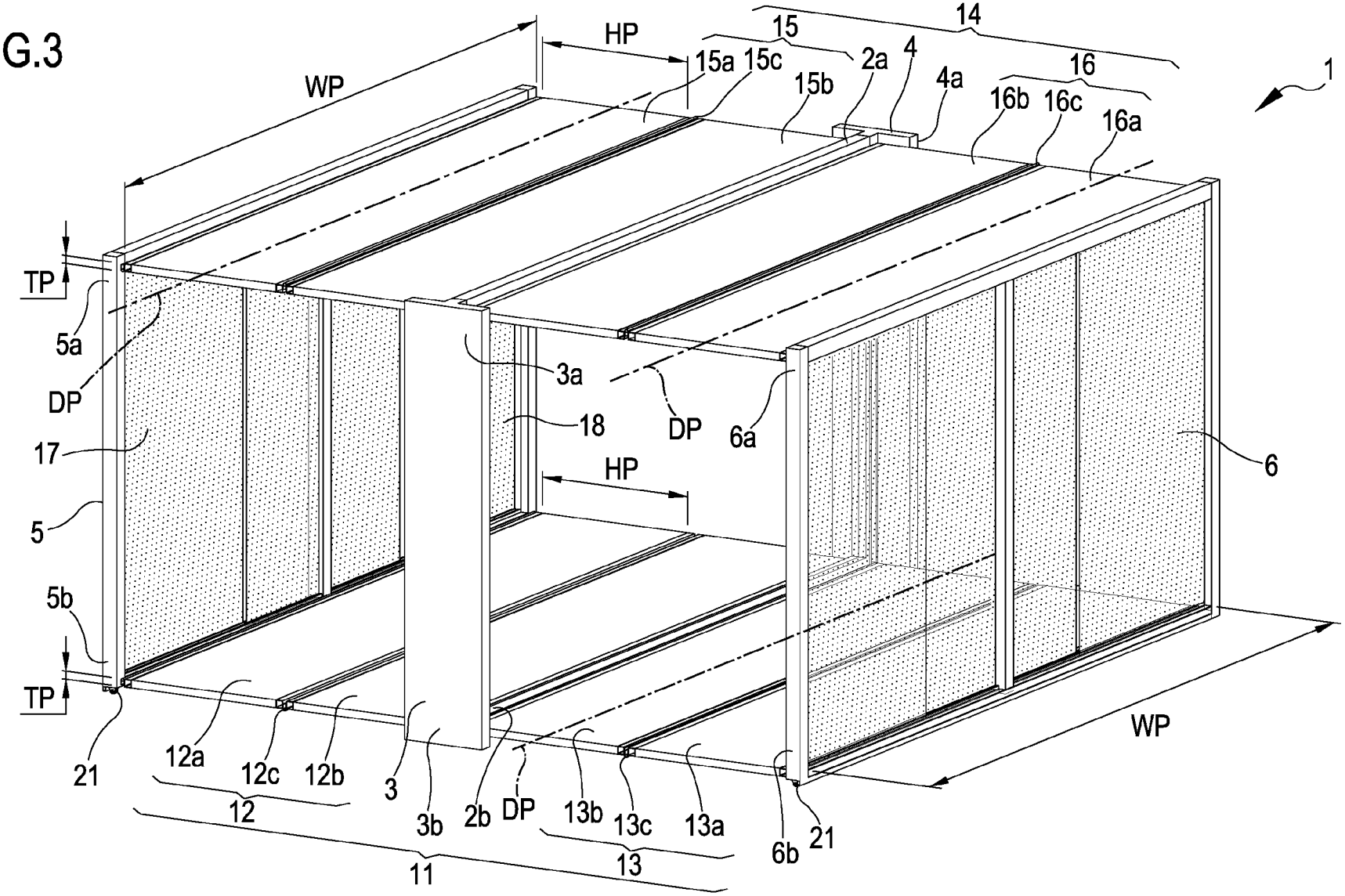
FIG. 3 represents the extendable structure of FIG. 2 in the completely extended configuration, in which the floor element and the ceiling element are spread out.

The structure 1 in accordance with the present description is of extendable. The extendable structure 1 is adapted to operate between a retracted configuration and a completely extended configuration. FIG. 1 illustrates the extendable structure 1 in its retracted configuration, in which the extendable structure 1 has a compact shape with minimum size. In such compact shape, the extendable structure 1 can be easily transported. FIG. 3 instead illustrates the completely extended configuration of the extendable structure, in which it has a greater size than the minimum size. Preferably, the extendable structure 1 has, in the completely extended configuration, a maximum size. As is seen in greater detail hereinbelow, the transition of the extendable structure 1 from the retracted configuration to the completely extended configuration is possible by means of a step of opening the extendable structure 1, illustrated as an example in FIG. 2. During the opening step, the extendable structure 1 assumes a plurality of subsequent partially extended configurations in which the structure 1 progressively increases an internal volume thereof up to reaching the configuration with maximum internal volume, represented by the completely extended configuration. The at least partially extended configuration of the extendable configuration 1, intermediate between the retracted configuration and the completely extended configuration, is illustrated, with reference to several embodiments of the invention, in FIGS. 6, 9 and 11.

The extendable structure 1 is also of retractable type. The retractable structure 1 is configured for being retracted so as to decrease and, in the retracted configuration, minimize the size thereof. The arrangement of the structure 1 to be retracted is particularly advantageous since it allows the structure 1 to assume, starting from the completely extended configuration, the retracted configuration with minimum size. In addition, in the retracted configuration, the structure 1 can also be stackable with other structures 1, also in retracted configuration, or side by side other structures 1, also in retracted configuration, in a manner such to allow the optimization or the minimization of the storage space or storage space of a plurality of structures 1. The transition of the structure 1 extendable from the completely extended configuration to the retracted configuration is possible by means of a step of closing the structure 1. During the closing step, the extendable structure 1 assumes a plurality of successive partially retracted configurations in which the structure 1 progressively decreases an internal volume thereof up to reaching the configuration with minimum internal volume, represented by the retracted configuration. For the sake of completeness, it is necessary to specify that the partially retracted configurations of the structure 1 correspond to respective partially extended configurations of the structure 1, since they constitute intermediate configurations between the completely extended configuration and the retracted configuration that are assumed by the structure 1 both in the opening step and in the closing step. Consequently, each partially extended configuration of the structure 1 can coincide with the respective partially retracted configuration of the structure 1, as a function of the fact that the structure 1 is situated respectively in the opening step or closing step. In light of that stated above, the writing "partially extended configuration" and "partially retracted configuration" can be used interchangeably for the purpose of the present description. With regard to the partially retracted configuration of the structure 1, reference is therefore made to the analogous partially extended configurations of the structure 1 pursuant to the FIGS. 2, 6, 9 and 11.

In the course of the present description, reference will be made to the extendable and retractable structure 1 simply as "structure" and to the intermediate configurations as "partially extended configurations" or "at least partially extended configurations".

The structure 1 comprises a box-like body 2. The box-like body 2 is defined with reference to the closed configuration of the structure 1. In the closed configuration of the structure 1, the box-like body 2 defines the compact shape of the structure 1 and delimits the minimum size that the structure 1 can assume (see FIG. 1).

In accordance with the embodiment illustrated in the enclosed figures, the box-like body 2 comprises a first upright 3, a second upright 4, a first lateral wall 5 and a second lateral wall 6. The first upright 3 and the second upright 4 are substantially parallel and opposite each other. The first lateral wall 5 and the second lateral wall 6 are in turn substantially parallel and opposite each other and constitute sides of the box-like body 2 of the structure 1. It is intended that further embodiments can be provided, not illustrated in the enclosed figures, in which the box-like body 2 can provide for a single upright and/or a single lateral wall. In a possible embodiment which provides for a first upright 3 and a second upright 4, the box-like body 2 can also provide for a crosspiece 2*a* adapted to connect the uprights 3, 4 at respective upper portions 3*a*, 4*a* of the uprights 3, 4 or a base or connection portion 2*b* adapted to connect the uprights 3, 4 at respective lower portions 3*b*, 4*b* of the uprights 3, 4.

Hereinbelow, the first upright 3 and the second upright 4 are described in greater detail. The first upright 3 and the second upright 4 preferably have an analogous structure and are extended along a respective main extension direction D3, D4. As illustrated in FIG. 1, the main extension directions D3, D4 of the uprights 3, 4 are parallel to each other. Each upright 3, 4 preferably has a parallelepiped shape. In the embodiments illustrated in the enclosed figures, each upright 3, 4 has a parallelepiped shape with rectangular base. In a possible alternative embodiment not illustrated in the enclosed figures, each upright 3, 4 can have two main extension directions and can have a parallelepiped shape with square base. The first upright 3 and the second upright 4 also have respective upper portions 3*a*, 4*a* and respective lower portions 3*b*, 4*b* defined with reference to the main extension direction D3, D4 of the uprights 3, 4. As illustrated in the enclosed figures, the first upright 3 and the second upright 4 have a same height H3, H4. The height H3, H4 of each upright 3, 4 is defined as the distance between respective ends of the lower portion 3*b*, 4*b* and of the upper portion 3*a*, 4*a* of the upright 3, 4. The height H3, H4 of the uprights 3, 4 is defined along the respective main extension directions D3, D4 of the uprights 3, 4. Preferably, the height H3, H4 of each upright 3, 4 is at least equal to 1.5 m (4.92 ft) or to 2 m (6.56 ft) or to 2.5 m (8.20 W. In particular, the height H3, H4 of each upright 3, 4 can be substantially equal to 2.8 m (9.19 W. In an alternative embodiment not illustrated in the enclosed figures, the height H3 of the first upright 3 can differ from the height H4 of the second upright 4. The height H3, H4 of each upright 3, 4 is preferably constant along a direction orthogonal to the main extension direction D3, D4 of the upright 3, 4. In a possible alternative embodiment, the height H3, H4 of the uprights 3, 4 can vary along a direction orthogonal to the main extension direction D3, D4 of the uprights 3, 4, in an analogous or different manner between uprights 3, 4. As illustrated in the enclosed figures, the height H3, H4 of the uprights 3, 4 defines a height H2 of the box-like body 2 (see FIG. 1). The height H2 of the box-like body 2 substantially corresponds to a height of the structure 1. The height of the box-like body H2 and the height of the structure 1 are preferably at least equal to 1.5 m (4.92 ft) or to 2 m (6.56 ft) or to 2.5 m (8.20 ft). In particular, the height H2 of the box-like body 2 and the height of the structure 1 are substantially equal to 2.8 m (9.19 ft). The height of the structure 1 in the retracted configuration is preferably equal to the height of the structure 1 in the completely extended configuration. In addition, the height of the structure 1 is preferably constant in the opening step and in the step of closing the structure 1. The height of the structure 1 in the retracted configuration is therefore preferably equal to the height of the structure 1 in the at least partially extended configurations intermediate between the retracted configuration and the completely extended configuration. The structure 1 can have a same height in the retracted configuration, in the partially extended configurations and in the completely extended configuration.

As illustrated in the enclosed figures, the first upright 3 and the second upright 4 have a same width W3, W4. The width W3, W4 of each upright 3, 4 is defined as the distance between opposite sides of the upright 3, 4. The width W3, W4 of the uprights 3, 4 is defined orthogonal to the height H3, H4 of the uprights 3, 4. Preferably, the width W3, W4 of each upright 3, 4 is at least equal to 0.5 m (1.64 ft) or to 0.7 m (2.30 ft) or to 0.9 m (2.95 ft). In an alternative embodiment not illustrated in the enclosed figures, the width W3 of the first upright 3 can differ from the width W4 of the second upright 4. The width W3, W4 of each upright 3, 4 is preferably constant along the main extension direction D3, D4 of the upright 3, 4. In a possible alternative embodiment, the width W3, W4 of the uprights 3, 4 can vary along the respective main extension direction D3, D4, in an analogous or different manner between uprights 3, 4. As illustrated in the enclosed figures, the width W3, W4 of the uprights 3, 4 defines a width W2 of the box-like body 2. The width W2 of the box-like body 2 substantially corresponds, in the retracted configuration of the structure 1, to a minimum width of the structure 1.

Each upright 3, 4 can also have a same thickness T3, T4. The thickness T3, T4 of each upright 3, 4 is extended between substantially planar opposite surfaces of the upright 3, 4. The thickness T3, T4 of each upright 3, 4 is defined orthogonal to the width W3, W4 and to the height H3, H4 of each upright 3, 4 and is smaller than the height H3, H4 the width W3, W4 of each upright 3, 4. The thickness T3, T4 of each upright 3, 4 can be smaller at least by one order of magnitude with respect to the height H3, H4 of the upright 3, 4. In an alternative embodiment not illustrated in the enclosed figures, the thickness T3 of the first upright 3 can differ from the thickness T4 of the second upright 4. The thickness T3, T4 of each upright 3, 4 is preferably constant along the width W3, W4 of the upright 3, 4 and along the height H3, H4 of the upright 3, 4. In such embodiment, the opposite surfaces of each upright 3, 4 are substantially parallel to each other. In a possible alternative embodiment, the thickness T3, T4 of the uprights 3, 4 can vary along the width W3, W4 of the uprights 3, 4 and/or along the height H3, H4 of the uprights 3, 4, in an analogous or different manner between uprights 3, 4.

Hereinbelow, the first lateral wall 5 and the second lateral wall 6 will be described in greater detail.

As illustrated in the enclosed figures, the first lateral wall 5 and the second lateral wall 6 preferably have an analogous structure and are extended along a respective main extension direction D5, D6. The main extension directions D5, D6 of the lateral walls 5, 6 are parallel to each other (see FIG. 1). The first lateral wall 5 and the second lateral wall 6 also have respective upper portions 5*a*, 6*a* and respective lower portions 5*b*, 6*b* defined with reference to the main extension direction D5, D6 of the lateral walls 5, 6. As illustrated in the enclosed figures, the first lateral wall 5 and the second lateral wall 6 have a same height H5, H6. The height H5, H6 of each lateral wall 5, 6 is defined as the distance between respective ends of the lower portion 5*b*, 6*b* and of the upper portion 5*a*, 6*a* of the lateral wall 5, 6. The height H5, H6 of the lateral walls 5, 6 is defined parallel to the respective main extension directions D5, D6 of the lateral walls 5, 6. The height H5, H6 of the lateral walls 5, 6 is also parallel to the main extension direction D3, D4 of the uprights 3, 4 and to the height H3, H4 of the uprights 3, 4. The height H5, H6 of the lateral walls 5, 6 can be a same order of magnitude as the height H3, H4 of the uprights 3, 4. As illustrated in FIG. 1, the height H5, H6 of the lateral walls 5, 6 is substantially equal to the height H3, H4 of the uprights 3, 4. Preferably, the height H5, H6 of each lateral wall 5, 6 is at least equal to 1.5 m (4.92 ft) or to 2 m (6.56 ft) or to 2.5 m (8.20 ft). In particular, the height H5, H6 of each lateral wall 5, 6 is substantially equal to 2.8 m (9.19 ft). As illustrated in the enclosed figures, the first lateral wall 5 and the second lateral wall 6 have a same width W5, W6 defined as the distance between opposite sides of the lateral walls 5, 6. The width W5, W6 of the lateral walls 5, 6 is defined orthogonal to the height H5, H6 of the lateral walls 5, 6. The width W5, W6 of the lateral walls 5, 6 is also defined orthogonal to the width W3, W4 of the uprights 3, 4. Preferably, the width W5, W6 of each lateral wall 5, 6 is at least equal to 3 m (9.84 ft) or to 4 m (13.12 ft) or to 5 m (16.40 ft). In particular, the width W5, W6 of each lateral wall 5, 6 can be substantially equal to 6 m (19.68 ft). In an alternative embodiment not illustrated in the enclosed figures, the width W5 of the first lateral wall 5 can differ from the width W6 of the second lateral wall 6. The width W5, W6 of each lateral wall 5, 6 is preferably constant along the main extension direction D5, D6 of the lateral wall 5, 6. In a possible alternative embodiment, the width W5, W6 of the lateral walls 5, 6 can vary along the respective main extension direction D5, D6, in an analogous or different manner between lateral walls 5, 6. In the embodiment illustrated in the enclosed figures, the width W5, W6 of each lateral wall 5, 6 is preferably greater than the height H5, H6 of the lateral wall 5, 6. In alternative embodiments, the width W5, W6 of each lateral wall 5, 6 can be smaller than the height H5, H6 of the lateral wall 5, 6 or substantially equal to the height H5, H6 of the lateral wall 5, 6. The width W5, W6 of the lateral walls 5, 6 can substantially correspond to the distance between the uprights 3, 4 (see FIG. 1). As illustrated in the enclosed figures, the width W5, W6 of the lateral walls 5, 6 substantially defines, in the retracted configuration of the structure 1, a depth P2 of the box-like body. In particular, the depth P2 of the box-like body is equal to the sum of the width W5, W6 of the lateral walls 5, 6 and the thicknesses T3, T4 of the uprights 3, 4. The depth P2 of the box-like body 2 substantially corresponds to a depth of the structure 1. The depth P2 of the box-like body 2 and of the structure 1 are preferably at least equal to 3 m (9.84 ft) or to 4 m (13.12 ft) or to 5 m (16.40 ft). In particular, the depth P2 of the box-like body 2 and of the structure 1 are substantially equal to 6 m (19.68 ft). The depth of the structure 1 in the retracted configuration is preferably equal to the depth of the structure 1 in the completely extended configuration. In addition, the depth of the structure 1 is preferably constant in the opening step and in the step of closing the structure 1. The depth of the structure 1 in the retracted configuration is therefore preferably equal to the depth of the structure 1 in the at least partially extended configurations intermediate between the retracted configuration and the completely extended configuration of the structure 1. As illustrated in the enclosed figures, the structure 1 can have a same depth in the retracted configuration, in the partially extended configurations and in the completely extended configuration.

Each lateral wall 5, 6 can also have a same thickness T5, T6. The thickness T5, T6 of each lateral wall 5, 6 is extended between substantially planar opposite surfaces of the lateral wall 5, 6. The thickness T5, T6 of each lateral wall 5, 6 is defined orthogonal to the width W5, W6 and to the height H5, H6 of each lateral wall 5, 6 and is smaller than the height H5, H6 and the width W5, W6 of each lateral wall 5, 6. The thickness T5, T6 of each lateral wall 5, 6 can be smaller at least by one order of magnitude with respect to the width W5, W6 of the lateral wall 5, 6. In addition, the thickness T5, T6 of each lateral wall 5, 6 can be smaller at least by one order of magnitude with respect to the height H5, H6 of the lateral wall 5, 6. In an alternative embodiment not illustrated in the enclosed figures, the thickness T5 of the first lateral wall 5 can differ from the thickness T6 of the second lateral wall 6. The thickness T5, T6 of each lateral wall 5, 6 is preferably constant along the width W5, W6 of the lateral wall 5, 6 and along the height H5, H6 of the lateral wall 5, 6. In such embodiment, the opposite surfaces of each lateral wall 5, 6 are substantially parallel to each other. In a possible alternative embodiment, the thickness T5, T6 of the lateral walls 5, 6 can vary along the width W5, W6 of the lateral walls 5, 6 and/or along the height H5, H6 of the lateral walls 5, 6, in an analogous or different manner between lateral walls 5, 6. The thickness T5, T6 of the lateral walls 5, 6 can be substantially analogous or comparable to the thickness T3, T4 of the uprights 3, 4.

As will be seen in greater detail hereinbelow, each lateral wall 5, 6 is configured for being moved away or towards the uprights 3, 4. Each lateral wall 5, 6 can be moved, starting from the retracted configuration of the structure 1, in moving away from the uprights 3, 4 up to reaching the completely extended configuration of the structure 1. The movement of the lateral walls 5, 6 in moving away from the uprights 3, 4 takes place in the step of opening the structure 1. Vice versa, each lateral wall 5, 6 can be moved, starting from the completely extended configuration of the structure 1, in approaching the uprights 3, 4 up to reaching the retracted configuration of the structure 1. The movement of the lateral walls 5, 6 in approaching the uprights 3, 4 takes place in the step of closing the structure 1.

The lateral walls 5, 6 can be configured for being selectively moved or moved in an interdependent or correlated manner. Preferably, the lateral walls 5, 6 are configured for being simultaneously moved. In a possible embodiment, the lateral walls 5, 6 can be configured for being moved in accordance with a specific sequence, which can for example provide for moving, in a first moment, the first lateral wall 5 and in a second moment the second lateral wall 6, or vice versa.

Figure 4:
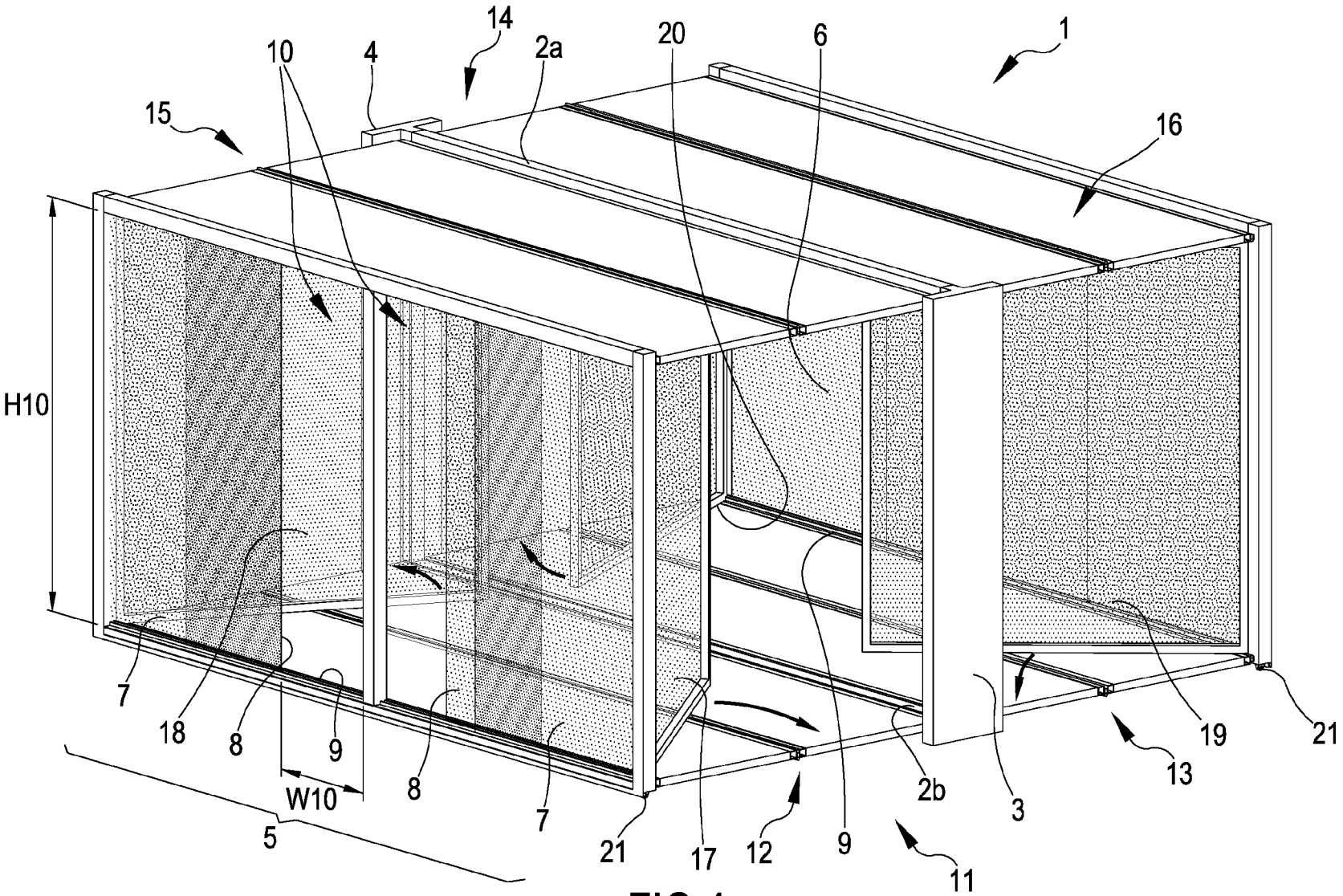
FIG. 4 represents the extendable structure of FIG. 3, in which the additional walls are moved in rotation with respect to the respective lateral walls.

At least one lateral wall 5, 6 can comprise at least one static portion 7 and at least one slidable portion 8. The slidable portion 8 is configured for sliding with respect to the static portion 7. The lateral wall 5, 6 can comprise a guide 9 configured for allowing the sliding of the slidable portion 8 with respect to the static portion 7. FIG. 4 illustrates an embodiment in which the first lateral wall 5 comprises two slidable portions 8 and two static portions 7 and shows that the sliding of each slidable portion 8 with respect to the respective static portion 7 defines a gap 10 at the first lateral wall 5. At least one analogous gap 10 can be defined at the second lateral wall 6. Advantageously, the gap 10 is intended and sized for allowing, e.g. for allowing a user, to enter into the structure 1 or exit from the structure 1. For such purpose, the gap 10 can have a height H10 at least equal to 1.7 m (5.58 ft) or to 1.85 m (6.07 ft) or to 2 m (6.56 ft) and a width W10 at least equal to 0.5 m (1.64 ft) or to 0.75 m (2.46 ft) or to 1 m (3.28 ft). Such width W10 can be defined when the gap 10 is in the completely open configuration, in which the slidable portion 8 of the lateral wall is at the end stop. The width W10 of the gap 10 progressively increases during the sliding of the slidable portion 8 with respect to the respective static portion 7 aimed to open the gap 10 itself and progressively decreases during the sliding, in opposite direction, of the slidable portion 8 with respect to the respective static portion 7 aimed to close the gap 10 itself. Preferably, each lateral wall 5, 6 comprises a static portion 7 and a slidable portion 8 adapted to define a gap 10 and a guide 9 configured for sliding the slidable portion 8 with respect to the static portion 7. In accordance with such embodiment, both the first lateral wall 5 and the second lateral wall 6 can have at least one respective gap 10, which can act as an entrance or exit for a user. Providing for a plurality of gaps 10 advantageously allows, in the completely extended configuration of the structure 1, greater accessibility to the internal volume of the structure 1.

The structure 1 is of at least partially foldable type. As will be seen in greater detail in the following present description, the arrangement of several portions of the structure 1 to be spread out and folded allows, respectively, the opening and closing of the structure 1. Hereinbelow, the foldable elements of the structure 1 are described which allow an easy, effective and optimized opening and closing thereof.

The structure 1 has a foldable floor element 11 hinged in proximity to or at the lower portions 3*b*, 4*b* of the uprights 3, 4. Being foldable, the floor element 11 advantageously allows the structure 1 to carry out the transition between the retracted configuration and the completely extended configuration, and vice versa. As illustrated in the enclosed figures, the foldable floor element 11 comprises a first foldable floor portion 12 and a second foldable floor portion 13. The first foldable floor portion 12 and the second foldable floor portion 13 are extended on opposite sides with respect to the uprights 3, 4. In particular, as illustrated in the enclosed figures, the first foldable floor portion 12 and the second foldable floor portion 13 have a substantially mirrored structure with respect to a plane crossing through the uprights parallel to a main extension direction D3, D4 of the uprights 3, 4. The first foldable floor portion 12 is preferably separated with respect to the second foldable floor portion 13. Optionally, the first foldable floor portion 12 can be moved, and in particular folded or spread out, in an independent manner with respect to the second foldable floor portion 13. In an alternative embodiment not illustrated in the enclosed figures, the foldable floor element 11 can comprise a single foldable floor portion, extended in proximity to one side of a lower portion 3*b*, 4*b* of the uprights 3, 4. As illustrated in the enclosed figures, in the embodiments which provide for a first and a second foldable floor portion 12, 13, each foldable floor portion 12, 13 comprises a respective first panel 12*a*, 13*a*, a respective second panel 12*b*, 13*b* and a respective hinge 12*c*, 13*c*. Hereinbelow, the characteristics of the first panel 12*a*, 13*a* of the second panel 12*b*, 13*b* and of the hinge 12*c*, 13*c* are described, which can be common to each foldable floor portion 12, 13. The hinge 12*c*, 13*c* is extended longitudinally with respect to the panels 12*a*, 13*a* and parallel to the distance W5, W6 between the first and the second upright 3, 4. The first panel 12*a*, 13*a* and the second panel 12*b*, 13*b* are hinged to each other by means of the hinge 12*c*, 13*c* and are configured for rotating one with respect to the other around the hinge 12*c*, 13*c*. As an alternative to the hinge 12*c*, 13*c*, a flexible or elastically deformable portion of the foldable floor element 12, 13 can be provided, or an element can be provided that is adapted to functionally act as a hinge or any one element configured for allowing the folding and the spreading out of the floor element 12, 13. In the embodiments illustrated in the enclosed figures, the first panel 12*a*, 13*a* and the second panel 12*b*, 13*b* of each foldable floor portion 12, 13 substantially have an analogous structure. In possible alternative embodiments, the first panel 12*a* and the second panel 12*b* of the first foldable floor portion 12 can have a structure and/or dimensions different from each other or different with respect to the structure and to the dimensions of the first panel 13*a* and of the second panel 13*b* of the second floor portion 13. Each panel 12*a*, 13*a*, 12*b*, 13*b* has a respective main extension direction DP and comprises sides opposite each other with reference to the main extension direction DP of the panel 12*a*, 13*a*, 12*b*, 13*b*. Each panel 12*a*, 13*a*, 12*b*, 13*b* preferably has a parallelepiped shape. In the embodiments illustrated in the enclosed figures, each panel 12*a*, 13*a*, 12*b*, 13*b* has a parallelepiped shape with rectangular base. In a possible alternative embodiment not illustrated in the enclosed figures, each panel 12*a*, 13*a*, 12*b*, 13*b* can have two main extension directions and can have a parallelepiped shape with square base. Each panel 12*a*, 13*a*, 12*b*, 13*b* has a substantially planar base. Along the main extension direction DP of each panel 12*a*, 13*a*, 12*b*, 13*b* is defined the width WP of the panel 12*a*, 13*a*, 12*b*, 13*b*. The width WP of each panel 12*a*, 13*a*, 12*b*, 13*b* is defined parallel to the width W5, W6 of the lateral walls 5, 6 and orthogonal to the uprights 3, 4. The width WP of each panel 12*a*, 13*a*, 12*b*, 13*b* is defined as the distance between the sides of the panel 12*a*, 13*a*, 12*b*, 13*b*. The width WP of each panel 12*a*, 13*a*, 12*b*, 13*b* can be substantially equal or comparable to the width W5, W6 of the lateral walls 5, 6. Each panel 12*a*, 13*a*, 12*b*, 13*b* also has a height HP defined along an extension direction orthogonal to the main extension direction DP of the panel 12*a*, 13*a*, 12*b*, 13*b*. The height HP of the panel 12*a*, 13*a*, 12*b*, 13*b* is orthogonal to the width WP of the panel 12*a*, 13*a*, 12*b*, 13*b*. The height HP of the panel 12*a*, 13*a*, 12*b*, 13*b* is defined as the distance between ends of the panel 12*a*, 13*a*, 12*b*, 13*b* opposite each other with reference to a direction orthogonal to the main extension direction DP of the panel 12*a*, 13*a*, 12*b*, 13*b*. The height HP of the panel 12*a*, 13*a*, 12*b*, 13*b* is preferably smaller than the width WP of the panel 12*a*, 13*a*, 12*b*, 13*b*. Each panel 12*a*, 13*a*, 12*b*, 13*b* also has a thickness TP defined between opposite surfaces of the panel 12*a*, 13*a*, 12*b*, 13*b* that are substantially planar and parallel to each other. As illustrated in the enclosed figures, the thickness TP of each panel 12*a*, 13*a*, 12*b*, 13*b* is preferably constant along the height HP and along the width WP of the panel 12*a*, 13*a*, 12*b*, 13*b*. In accordance with alternative embodiments, the thickness of each panel TP can vary along the height HP and/or along the width WP of the panel 12*a*, 13*a*, 12*b*, 13*b*.

The first panel 12*a*, 13*a* and the second panel 12*b*, 13*b* of each foldable floor portion 12, 13 are hinged to each other at respective facing ends. As illustrated in the enclosed figures, the opposite end of the first panel 12*a*, 13*a* is hinged at the lower portion 5*b*, 6*b* of the respective lateral wall 5, 6 and the opposite end of the second panel 12*b*, 13*b* is hinged in proximity to or at lower portions 3*b*, 4*b* of the uprights 3, 4. In particular, as illustrated in the enclosed figures, the first panel 12*a* of the first foldable floor portion 12 is hinged at one end thereof to a facing end of the second panel 12*b* of the first foldable floor portion 12 and is hinged to the lower portion 5*b* of the first lateral wall 5 at an opposite end thereof; in a mirrored manner, the first panel 13*a* of the second foldable floor portion 13 is hinged at one end thereof to a facing end of the second panel 13*b* of the second foldable floor portion 13 and is hinged to the lower portion 6*b* of the second lateral wall 6 at an opposite end thereof.

Figure 5:
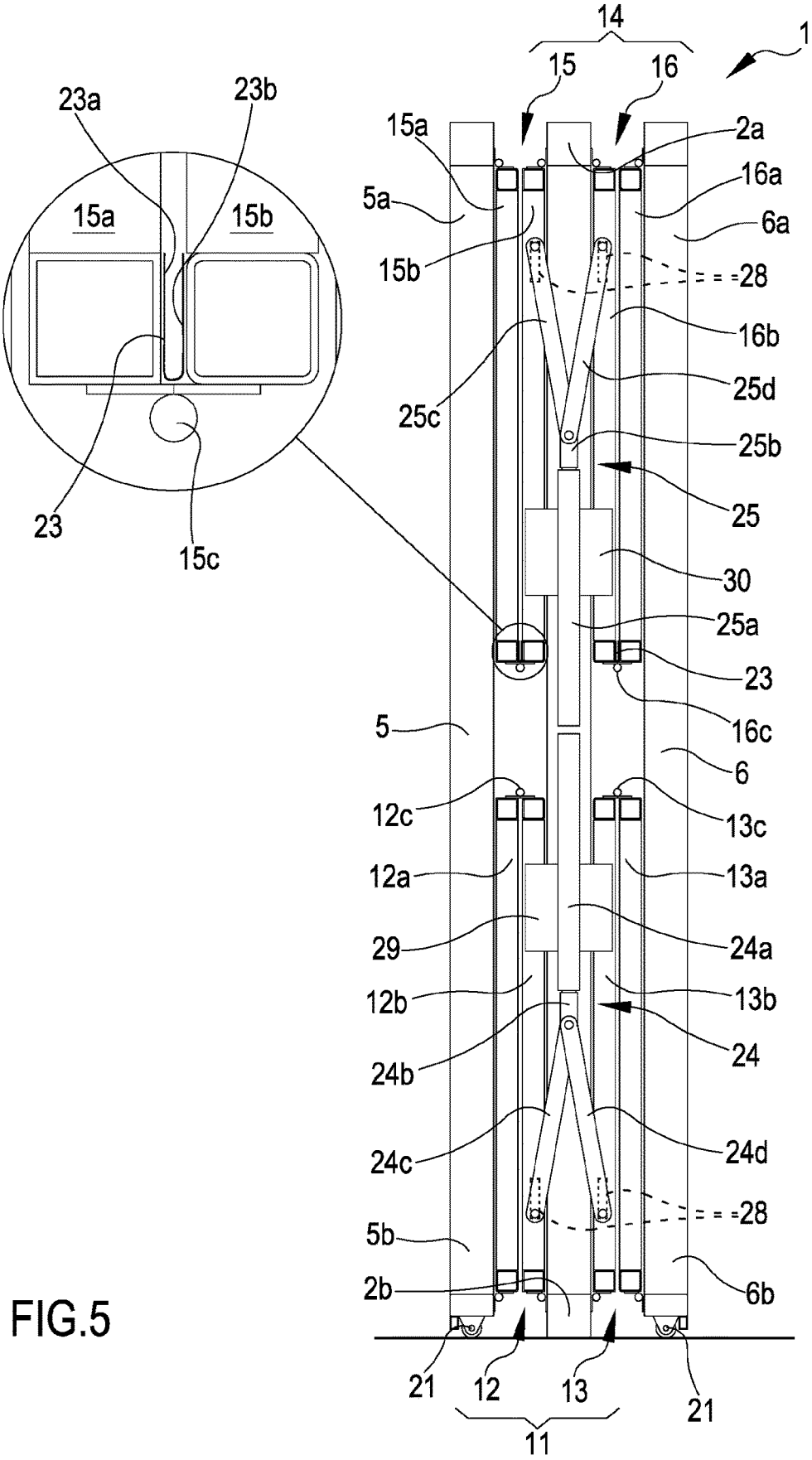
FIG. 5 represents an extendable structure in accordance with an exemplifying embodiment of the present description in the retracted configuration; the uprights have been removed from the structure in order to show the elements contained within the box-like body of the structure.
Figure 8:
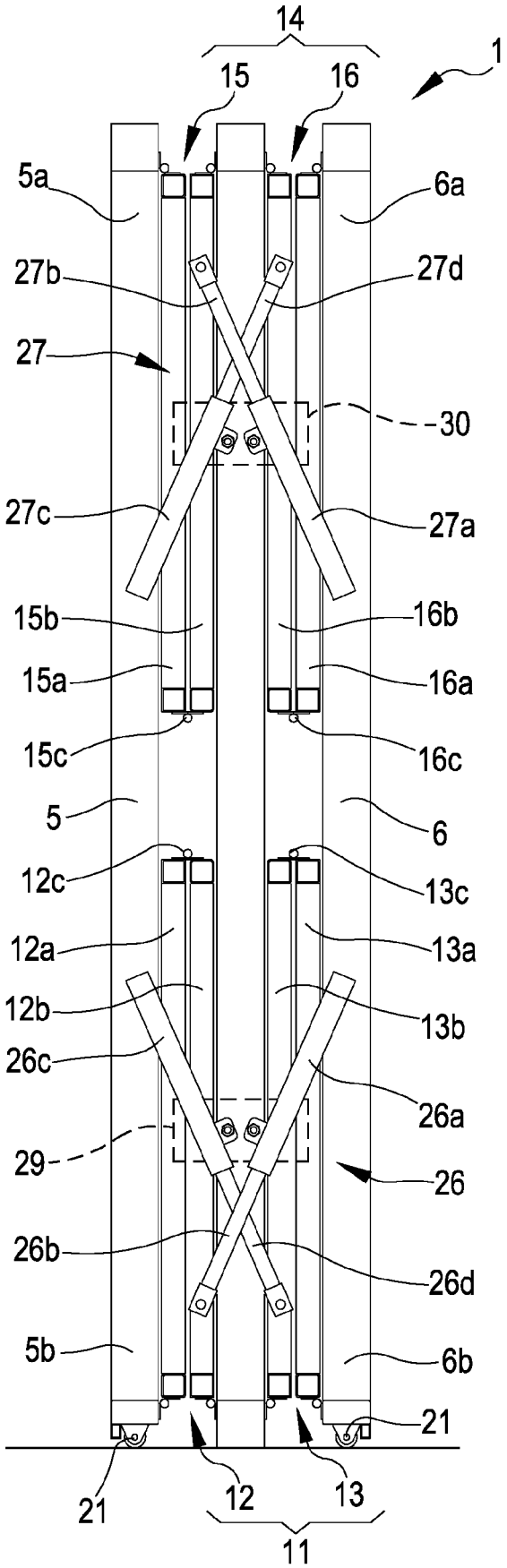
FIG. 8 represents an extendable structure in accordance with another exemplifying embodiment of the present description in the retracted configuration; the uprights have been removed from the structure in order to show the elements contained within the box-like body of the structure.

As illustrated in FIGS. 5 and 8, in the retracted configuration of the structure 1, the panels 12*a*, 12*b*, 13*a*, 13*b* of each foldable floor portion 12, 13 are folded together and the respective substantially planar surfaces face each other, determining a configuration of the foldable floor portions 12, 13 with minimum size. In the possible embodiment in which the thickness TP of each panel 12*a*, 13*a*, 12*b*, 13*b* varies along the height HP and/or along the width WP of the panel 12*a*, 13*a*, 12*b*, 13*b*, the thickness TP of the first panel 12*a*, 13*a* and of the second panel 12*b*, 13*b* of a same foldable floor portion 12, 13 preferably varies in a manner such that surfaces of the first panel 12*a*, 13*a* and of the second panel 12*b*, 13*b* intended to face each other in the retracted configuration of the structure are substantially counter-shaped with respect to each other in order to define a configuration with minimum lateral size of the box-like body 2.

Each foldable floor portion 12, 13 is preferably configured for being folded or spread out, determining the movement of the respective lateral wall 5, 6. The folding or the spreading out of each foldable floor portion 12, 13 is attained by respectively pulling or pushing at least one panel 12*a*, 12*b*, 13*a*, 13*b* of each foldable floor portion 12, 13. In one possible embodiment, in addition to or as an alternative to the possibility of pulling or pushing each foldable floor portion 12, 13, each foldable floor portion 12, 13 is configured for being folded or spread out as a function of a movement direction set to the respective lateral wall 5, 6 to which it is hinged. During the step of opening the structure 1, the movement of each foldable floor portion 12, 13 and of the respective lateral wall 5, 6 engaged thereto provides that the foldable floor portion 12, 13 is spread out by means of rotation-translation of the first panel 12*a*, 13*a* and of the second panel 12*b*, 13*b*. The structure 1, passing during the opening step through successive partially extended intermediate steps, reaches, at the end of the travel of the lateral wall 5, 6, the completely extended configuration illustrated in FIGS. 3, 7 and 10. In such configuration, each foldable floor portion 12, 13 is substantially planar and defines the floor of the structure 1. In an alternative embodiment not illustrated in the enclosed figures, at least one foldable floor portion 12, 13 might not be substantially planar as a function of the profile of the panels 12*a*, 13*a*, 12*b*, 13*b*. During the step of closing the structure 1, however, starting from the completely extended configuration of the structure 1, the pulling of the foldable floor portion 12, 13 or, in addition to or as an alternative, a translation set to a lateral wall 5, 6 engaged with the foldable floor portion 12, 13 in approaching the uprights 3, 4, causes a rotation-translation of the first panel 12*a*, 13*a* and of the second panel 12*b*, 13*b*. In substance, the pulling of at least one panel 12*a*, 13*a*, 12*b*, 13*b* of the foldable floor portion 12, 13 or the approaching of the lateral wall 5, 6 to the uprights 3, 4 causes a folding of the respective foldable floor portion 12, 13 around the hinge 12*c*, 13*c* arranged between the first panel 12*a*, 13*a* and the second panel 12*b*, 13*b*. As illustrated in the embodiments pursuant to the FIGS. 5-7 and 8-10, the panels of the floor element 12—on which the operation is conducted, preferably pulling and pushing in order to respectively cause the step of opening or closing the structure 1—are the secondi panels 13*b*, 14*b*, which are arranged in proximity to the uprights 3, 4. The steps of opening and closing the structure 1 will be illustrated hereinbelow with reference to the method for moving the structure 1.

The structure 1 also has a foldable ceiling element 14 hinged in proximity to or at the upper portions 3*a*, 4*a* of the uprights 3, 4. As described hereinbelow, the ceiling element 14 substantially has an analogous structure with respect to the floor element 11. As is detailed hereinbelow, the ceiling element 14 is configured for operating in accordance with a kinematic mechanism that is mirrored with respect to the kinematic mechanism of the previously described floor element 11. In particular, as illustrated in the enclosed figures, the ceiling element 14 and the floor element 11 are configured for being moved in a mirrored manner with respect to a plane, orthogonal to the main extension direction D3, D4 of the uprights 3, 4, crossing through a center line of the uprights 3, 4 or half-height of the uprights 3, 4. Being foldable, the ceiling element 14 advantageously allows the structure 1 to carry out the transition between the retracted configuration and the completely extended configuration, and vice versa. As illustrated in the enclosed figures, the foldable ceiling element 14 comprises a first foldable ceiling portion 15 and a second foldable ceiling portion 16. The first foldable ceiling portion 15 and the second foldable ceiling portion 16 are extended on opposite sides with respect to the uprights 3, 4. In particular, as illustrated in the enclosed figures, the first foldable ceiling portion 15 and the second foldable ceiling portion 16 have a structure substantially mirrored with respect to a plane crossing through the uprights 3, 4 parallel to the main extension direction D3, D4 of the uprights 3, 4. The first foldable ceiling portion 15 is preferably separated with respect to the second foldable ceiling portion 16. Optionally, the first foldable ceiling portion 15 can be moved, and in particular folded or spread out, independently with respect to the second foldable ceiling portion 16. As illustrated in the embodiments pursuant to FIGS. 5-7 and 8-10, the first lateral wall 5 can be guided in translation by the folding and spreading out of the first foldable ceiling portion 15 and of the first foldable floor portion 12 and the second lateral wall 6 can be guided in translation by the folding and spreading out of the second foldable ceiling portion 16 and of the second foldable floor portion 13. In one possible embodiment, in addition to or as an alternative to the possibility of pulling or pushing the foldable floor portion, each foldable floor portion 12, 13 and each foldable ceiling portion 15, 16 are configured for being folded or spread out as a function of a movement direction set to the respective lateral wall 5, 6 to which these are hinged. In an alternative embodiment not illustrated in the enclosed figures, the ceiling element 14 can comprise only one foldable ceiling portion, extended in proximity to one side of an upper portion 3*a*, 4*a* of the uprights 3, 4. Each foldable ceiling portion 15, 16 comprises a respective first panel 15*a*, 16*a*, a respective second panel 15*b*, 16*b* and a respective hinge 15*c*, 16*c*. In the embodiments illustrated in the enclosed figures, the panels 15*a*, 16*a*, 15*b*, 16*b* and the hinge 15*c*, 16*c* of each foldable ceiling portion 15, 16 have, mutatis mutandis, a structure substantially analogous to that of the panels 12*a*, 13*a*, 12*b*, 13*b* and of the hinge 12*c*, 13*c* described above with reference to the foldable floor portions 12 13. In possible alternative embodiments, the panels 15*a*, 16*a*, 15*b*, 16*b* of the foldable ceiling portions 15, 16 can have characteristics different from each other or with respect to the panels 12*a*, 13*a*, 12*b*, 13*b* of the foldable floor portions 12, 13. With regard to the structural, functional and kinematic characteristics of the panels 15*a*, 16*a*, 15*b*, 16*b* of the foldable ceiling portions 15, 16 reference is therefore made to the description of the panels 12*a*, 13*a*, 12*b*, 13*b* of the foldable floor portions 12, 13. In particular, in the enclosed figures, embodiments are illustrated in which the panels 15*a*, 16*a*, 15*b*, 16*b* of the foldable ceiling portions 15, 16 and the panels 12*a*, 13*a*, 12*b*, 13*b* of the foldable floor portions 12, 13 have a same height HP, a same width WP and a same thickness TP. The panels 12*a*, 13*a*, 12*b*, 13*b*, 15*a*, 16*a*, 15*b*, 16*b* are extended along respective main extension directions DP that are substantially parallel to each other.

The first panel 15*a*, 16*a* and the second panel 15*b*, 16*b* of each foldable ceiling portion 15, 16 are hinged to each other at respective facing ends. As illustrated in the enclosed figures, the opposite end of the first panel 15*a*, 16*a* is hinged at the upper portion 5*a*, 6*a* of the respective lateral wall 5, 6 and the opposite end of the second panel 15*b*, 16*b* is hinged in proximity to or at upper portions 3*a*, 4*a* of the uprights 3, 4. In particular, as illustrated in the enclosed figures, the first panel 15*a* of the first foldable ceiling portion 15 is hinged at one end thereof to a facing end of the second panel 15*b* of the first foldable ceiling portion 15 and is hinged to the upper portion 5*a* of the first lateral wall 5 at an opposite end thereof; in a mirrored manner, the first panel 16*a* of the second foldable ceiling portion 16 is hinged at one end thereof to a facing end of the second panel 16*b* of the second foldable ceiling portion 16 and is hinged to the upper portion 6*a* of the second lateral wall 6 at an opposite end thereof.

As illustrated in FIGS. 5 and 8, in the retracted configuration of the structure 1, the panels 15*a*, 15*b*, 16*a*, 16*b* of each foldable ceiling portion 15, 16 are folded together and the respective substantially planar surfaces face each other, determining a configuration of the foldable ceiling portions 15, 16 with minimum size. In the possible embodiment in which the thickness TP of each panel 15*a*, 16*a*, 15*b*, 16*b* varies along the height HP and/or along the width WP of the panel 15*a*, 16*a*, 15*b*, 16*b*, the width WP of the first panel

15*a*, 16*a* and of the second panel 15*b*, 16*b* of a same foldable ceiling portion 15, 16 preferably varies in a manner such that surfaces of the first panel 15*a*, 16*a* and of the second panel 15*b*, 16*b* intended to face each other in the retracted configuration of the structure are substantially counter-shaped with respect to each other in order to define a minimum lateral size of the box-like body 2.

As described below, the movement of the foldable ceiling portions 15, 16 is analogous to the movement previously described with reference to the foldable floor portions 12, 13 and mirrored thereto with respect to the plane crossing through the center line of the uprights 3, 4 or half-height of the uprights 3, 4 orthogonal to the main extension direction D3, D4 of the uprights 3, 4.

Each foldable ceiling portion 15, 16 is preferably configured for being folded or spread out, determining the movement of the respective lateral wall 5, 6. The folding or the spreading out of each foldable ceiling portion 15, 16 is attained by respectively pulling or pushing at least one panel 15*a*, 15*b*, 16*a*, 16*b* of each foldable ceiling portion 15, 16. In one possible embodiment, in addition to or as an alternative to the possibility of pulling or pushing each foldable ceiling portion 15, 16, each foldable ceiling portion 15, 16 is configured for being folded or spread out as a function of a movement direction set to the respective lateral wall 5, 6 to which it is hinged. During the step of opening the structure 1, the movement of each foldable ceiling portion 15, 16 and of the respective lateral wall 5, 6 engaged therewith provides that the foldable ceiling portion 15, 16 is spread out by means of rotation-translation of the first panel 15*a*, 16*a* and of the second panel 15*b*, 16*b*. The structure 1, passing during the opening step through successive partially extended intermediate steps, reaches, at the end of the travel of the lateral wall, the completely extended configuration illustrated in FIGS. 3, 7 and 10. In such configuration, each foldable ceiling portion 15, 16 is substantially planar and defines the ceiling of the structure 1. In an alternative embodiment not illustrated in the enclosed figures, at least one foldable ceiling portion 15, 16 might not be substantially planar as a function of the profile of the panels 15*a*, 15*b*, 16*a*, 16*b*. During the step of closing the structure 1, however, starting from the completely extended configuration of the structure 1, the pulling of the foldable ceiling portion 15, 16 or, in addition to or as an alternative, a translation set to a lateral wall 5, 6 engaged with the foldable ceiling portion 15, 16 in approaching the uprights 3, 4, causes a rotation-translation of the first panel 15*a*, 16*a* and of the second panel 15*b*, 16*b*. In substance, the pulling of at least one panel 15*a*, 15*b*, 16*a*, 16*b* of the foldable ceiling portion 15, 16 or the approaching of the lateral wall 5, 6 to the uprights causes a folding of the respective foldable ceiling portion 15, 16 around the hinge 15*c*, 16*c* arranged between the first panel 15*a*, 16*a* and the second panel 15*b*, 16*b*. As illustrated in the embodiments pursuant to FIGS. 5-7 and 8-10, the panels of the ceiling element 14 on which operation is preferably conducted by pulling or pushing, in order to respectively cause the closing step and opening step of the structure 1, are the second panels 15*b*, 16*b*, which are arranged in proximity to the uprights 3, 4.

Preferably, during the step of opening the structure 1, the spreading out of the first ceiling portion 15 occurs simultaneously and in a mirrored manner with respect to the spreading out of the first floor portion 12 and the spreading out of the second ceiling portion 16 occurs simultaneously and in a mirrored manner with respect to the spreading out of the second floor portion 13.

Analogously, during the step of closing the structure 1, the folding of the first ceiling portion 15 preferably occurs simultaneously and in a mirrored manner with respect to the folding of the first floor portion 12 and the folding of the second ceiling portion 16 preferably occurs simultaneously and in a mirrored manner with respect to the folding of the second floor portion 13.

The steps of opening and closing the structure 1 will be illustrated hereinbelow with reference to the method for moving the structure 1.

The size of the structure 1, both in the retracted configuration and in the completely extended configuration, can be a function of the dimensions of the panels 12*a*, 12*b*, 13*a*, 13*b*, 15*a*, 15*b*, 16*a*, 16*b* and can therefore be advantageously modulated by operating on the panels 12*a*, 12*b*, 13*a*, 13*b*, 15*a*, 15*b*, 16*a*, 16*b*, for example by replacing them with panels of different size or structure.

As illustrated in FIG. 3 and in FIG. 4, in the completely extended configuration the structure 1 is preferably of self-supporting type.

The structure 1 can also comprise at least one additional wall 17, 18, 19, 20 hinged to a lateral wall 5, 6. The additional wall 17, 18, 19, 20 is configured for integrally translating with the respective lateral wall 5, 6 during the step of opening the structure 1. In the completely extended configuration of the structure 1, the additional wall 17, 18, 19, 20 is configured for rotating with respect to the lateral wall 5, 6 around a hinge up to assuming a positioning orthogonal to the lateral wall 5, 6. In such positioning, the additional wall 17, 18, 19, 20 defines a confinement wall of the structure and contributes to delimiting an internal volume of the structure 1. As illustrated in the enclosed figures, the structure 1 can comprise a first pair of additional walls 17, 18 hinged in proximity to or at respective opposite sides of the first lateral wall 5 and a second pair of additional walls 19, 20 hinged in proximity to or at respective opposite sides of the second lateral wall 6. Each pair of additional walls 17, 18, 19, 20 comprises a first additional wall 17, 19 and a second additional wall 18, 20. The first additional wall 17, 19 and the second additional wall 18, 10 of each pair of additional walls is configured for integrally translating with the respective lateral wall 5, 6 during the step of opening the structure 1. In the completely extended configuration of the structure 1, the first additional wall 17, 19 and the second additional wall 18, 20 of each pair of additional walls is configured for selectively rotating with respect to the respective lateral wall 5, 6 around a respective hinge, up to assuming a respective positioning orthogonal to the respective lateral wall 5, 6. FIG. 4 illustrates two pairs of additional walls 17, 18, 19, 20 rotating with respect to the respective lateral wall 5, 6. In the configuration in which the additional walls 17, 18, 19, 20 are positioned in pairs orthogonal with respect to the respective lateral wall 5, 6, the additional walls 17, 18, 19, 20 define respective confinement walls of the structure and contribute to delimiting an internal volume of the structure 1. In the completely extended configuration of the structure 1 in which the additional walls 17, 18, 19, 20 are orthogonal to the lateral walls 5, 6, the confinement wall defined by the first additional wall 17, 19 is opposite, with reference to the respective lateral wall 5, 6, the confinement wall defined by the second additional wall 18, 20 of a same pair of additional walls. In such configuration, the internal volume of the structure 1 is perimetrically delimited by the first lateral wall 5, by the second lateral wall 6 and by the pairs of additional walls 17, 18, 19, 20. Analogous to that described above with reference to the lateral walls 5, 6, also one or more additional walls 17, 18, 19, 20 can have a respective gap 10, in a manner such to increase the accessibility to the internal volume of the structure 1. In the completely extended configuration of the structure 1 in which the additional walls 17, 18, 19, 20 are orthogonal to the respective lateral walls 5, 6, the additional walls 17, 18, 19, 20 can act as structural elements adapted to at least partially support the weight and the loads of the structure 1 itself, due for example to the foldable ceiling element 14 arranged above the additional walls 17, 18, 19, 20. Such structural function of the additional walls 17, 18, 19, 20 can advantageously contribute to rendering the structure 1 self-supporting.

The structure 1 can also comprise at least one element for aiding the movement 21. Preferably, as illustrated in the enclosed figures, a plurality of elements can be provided for aiding the movement 21 engaged at or in proximity to respective lower ends 5*b*, 6*b* of the first lateral wall 5 and of the second lateral wall 6. Each element for aiding the movement 21 is configured for facilitating the movement of the lateral walls 5, 6 in moving away from the uprights 3, 4 in the step of opening the structure 1 and in approaching the uprights 3, 4 in the step of closing the structure 1. The elements for aiding the movement 21 can be of rotary type. In the embodiments pursuant to the enclosed figures, by way of example a plurality of elements is illustrated for aiding the movement 21, in the form of small wheels. The elements for aiding the rotation 21, in addition to facilitating the transition of the structure 1 between the retracted and completely extended configurations and vice versa, can be configured for allowing the movement of the structure 1 in the completely extended configuration.

Figure 11:
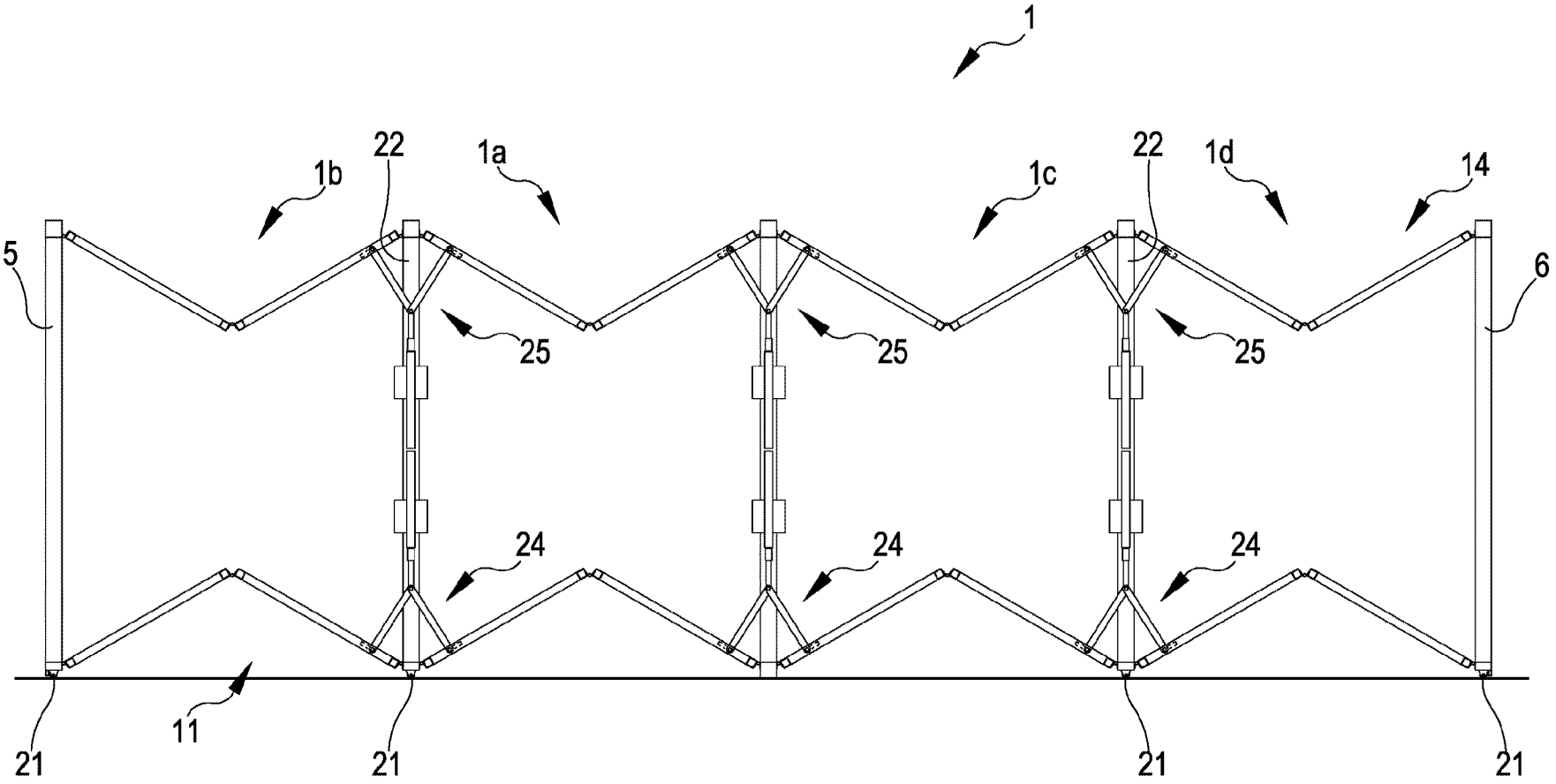
FIG. 11 represents an extendable modular structure in accordance with a further exemplifying embodiment of the present description in the opening step; the uprights have been removed from the structure.

As illustrated in the embodiment of FIG. 11, the structure 1 can be of modular type. The structure 1 of modular type comprises at least one first module 1*a* and one second module 1*b*. The first module 1*a* is engaged in proximity to or at the uprights 3, 4 and the second module 1*b* is engaged with the first module 1*a* on the opposite side with respect to the uprights 3, 4. In the completely extended configuration of the structure, each module 1*a*, 1*b* can substantially define a space of the structure 1. Between the first module 1*a* and the second module 1*b*, the structure 1 can provide for a dividing wall 22. The dividing wall 22 can provide for a gap 10 of the previously-described type. The gap 10 allows, for example allowing a user to access the spaces. The second module 1*b* is interposed between the lateral wall 5, 6 and the first module 1*a*. The second module 1*b* is engaged with a lateral wall 5, 6 and, on the opposite side and by means of the dividing wall 22, with the first module 1*a*. In the completely extended configuration of the structure 1, the dividing wall 22 can act as a structural element adapted to at least partially support the weight and the loads of the structure 1 itself, due for example to the foldable ceiling element 14 arranged above the dividing wall 22. Such structural function of the dividing wall 22 can advantageously contribute to making the structure 1 self-supporting. Preferably, the structure 1 of modular type comprises at least one first pair of modules 1*a*, 1*b* and at least one second pair of modules 1*c*, 1*d*. Each pair of modules has a first module 1*a*, 1*c*, a second module 1*b*, 1*d* and a dividing wall 22 interposed between the first module 1*a*, 1*c* and the second module 1*b*, 1*d*. The pairs of modules 1*a*, 1*b*, 1*c*, 1*d* are arranged at opposite sides of the uprights 3, 4. In particular, the first modules 1*a*, 1*c* can be arranged in proximity to the uprights 3, 4 at opposite sides. As illustrated in FIG. 11, the second module 1*b* of the first pair of modules can be interposed between the first module 1*a* of the first pair of modules and the first lateral wall 5 and the second module 1*d* of the second pair of modules can be interposed between the first module 1*c* of the second pair of modules and the second lateral wall 6.

In accordance with a further embodiment not illustrated in the enclosed figures, the structure 1 can be extended over two or more levels. Hereinbelow, a possible embodiment is described in which the structure 1 is extended over a first level and over a second level. The levels of the structure 1 are extended at different heights. The second level is arranged above the first level. In such embodiment, the structure 1 can comprise an intermediate foldable element. Being foldable, the intermediate element advantageously allows the structure 1 to carry out the transition between the retracted configuration and the completely extended configuration, and vice versa. The intermediate element is engaged in proximity to or at the center line or half-height of the uprights 2, 3. The intermediate element is interposed between the floor element 11 and the ceiling element 14 and delimits the two levels. In particular, the first level is defined between the floor element 11 and the intermediate element and the second level is defined between the intermediate element and the ceiling element 14. The intermediate foldable element is configured for being folded and spread out analogously to that described above for the floor element 11 and for the ceiling element 14. In particular, the intermediate foldable element can be folded and spread out in accordance with the same kinematic mechanism described above with reference to the floor element 11 and to the ceiling element 14. Analogous to the foldable floor element 11 and ceiling element 14, the intermediate foldable element can comprise a first intermediate foldable portion and a second intermediate foldable portion. The first intermediate foldable portion and the second intermediate foldable portion are extended in proximity to opposite sides of the uprights 3, 4. With reference to the completely extended configuration of the structure 1, the first intermediate foldable portion is interposed between the first foldable ceiling portion 15 and the first foldable floor portion 12 and, analogously, the second intermediate foldable portion is interposed between the second foldable ceiling portion 16 and the second foldable floor portion 13. Each intermediate foldable portion can in turn comprise a first panel, a second panel and a hinge configured for allowing the relative rotation between the panels. The structural, functional and kinematic characteristics, of the panels and of the hinges of the intermediate foldable portions can be analogous, mutatis mutandis, to the structural, functional and kinematic characteristics described above with reference to the panels and to the hinges of the foldable floor portions 12, 13. In particular, as an alternative to the hinge, a flexible or elastically deformable portion of the intermediate foldable element can be provided, or an element can be provided adapted to functionally act as a hinge or any one element configured for allowing the folding and the spreading out of the intermediate element.

Opposite ends of the first intermediate foldable portion are engaged at or in proximity respectively to the center line or half-height of the uprights 3, 4 and of the first lateral wall 5; analogously, opposite ends of the second intermediate foldable portion are engaged at or in proximity respectively to the center line or half-height of the uprights 3, 4 and of the second lateral wall 6. The first intermediate foldable portion and the second intermediate foldable portion can be spread out in the step of opening the structure 1, by pushing at least one respective panel or by the movement respectively set to the first lateral wall 5 and to the second lateral wall 6 in moving away from the uprights 3, 4. Analogously, in step of closing the structure 1, the first intermediate foldable portion and the second intermediate foldable portion can be folded by pulling at least one respective panel or by the movement respectively of the first lateral wall 5 and of the second lateral wall 6 in approaching the uprights 3, 4.

In possible embodiments of the structure 1 which provide more than two levels, the structure 1 has a number of intermediate foldable elements equal to the number of levels minus one; for example, in the case of three levels, the structure can provide for two intermediate foldable elements, in the case of four levels the structure can provide for three intermediate foldable elements, etc.

In an embodiment not illustrated in the enclosed figures, the structure 1 can be of modular type and be extended over at least two planes. In such embodiment, each level can have a plurality of modules 1*a*, 1*b*, 1*c*, 1*d*.

The structure 1 can also comprise a sheath 23 arranged at a respective portion of external surfaces of the first panel 15*a*, 16*a* and of the second panel 15*b*, 16*b* of each foldable ceiling portion 15, 16. The external surfaces of the panels 15*a*, 15*b*, 16*a*, 16*b* are opposite internal surfaces of the panels 15*a*, 15*b*, 16*a*, 16*b* configured for facing, in the completely extended configuration of the structure 1, the internal volume of the cavity defined by the structure 1. The portions of the external surfaces of the first panel 15*a*, 16*a* and of the second panel 15*b*, 16*b* are placed in proximity to the respective hinge 15*c*, 16*c* by means of which the respective panels 15*a*, 15*b*, 16*a*, 16*b* are hinged. As exemplifying illustrated in FIG. 6 and in FIG. 7, each sheath 23 surmounts the respective hinge 15*c*, 16*c* and is configured for preventing the entrance of weather phenomena, such as rain, from outside the structure 1 to the interior the volume defined by the structure 1. The sheath 23 comprises flaps 23*a*, 23*b* configured for being opened in the step of opening the structure 1. The flaps 23*a*, 23*b* are also configured for moving close to each other in the step of closing the structure 1. As illustrated in detail of FIG. 5, in the retracted configuration of the structure 1 the sheath 23 has a substantially U-shaped conformation, in which the flaps 23*a*, 23*b* are moved close to each other and face each other. In the opening step or closing step of the structure 1, the flaps 23*a*, 23*b* of the sheath 23 are progressively opened and the sheath 23 has a substantially V-shaped conformation (see FIG. 6). During the step of opening the structure 1, the angle defined by the flaps 23*a*, 23*b* of the sheath 23 (the angle at the vertex of the "V") is progressively increased, tending to render the flaps 23*a*, 23*b* of the sheath 23 substantially coplanar. As illustrated in the detail of FIG. 7, the flaps 23*a*, 23*b* of the sheath 23 are substantially coplanar in the completely extended configuration of the structure 1; in such configuration, the sheath 23 can have a concave central portion, which surmounts the respective hinge 15*c*, 16*c* above which the sheath 23 is arranged. In a reverse manner, in step of closing the structure 1, the sheath 23 passes from the completely extended configuration in which the flaps 23*a*, 23*b* are substantially coplanar, to the at least partially extended configuration in which the sheath 23 assumes a substantially V-shaped conformation, to the retracted configuration in which the sheath 23 has a substantially U-shaped conformation. The sheath 23 can be flexible or foldable; such characteristic allows the deformations of the sheath 23 described above with reference to the steps of opening and closing the structure 1. Preferably, the sheath 23 is elastically deformable. The sheath 23 can also be removable; such characteristic can be advantageous so as to replace the sheath 23. The replacement of the sheath 23 could be necessary in the case of maintenance activity of the structure 1 or following damage of the sheath 23, for example due to weather phenomena.

The structure 1 can also comprise at least one actuator 24, 25, 26, 27 configured for determining the transition of the structure 1 from the retracted configuration to the completely extended configuration; such actuator 24, 25, 26, 27 is configured for managing the step of opening the structure. The actuator 24, 25, 26, 27 is preferably also configured for determining the transition of the structure 1 from the completely extended configuration to the retracted configuration; such actuator 24, 25, 26, 27 is also configured for managing the step of closing the structure 1. In an alternative embodiment, the structure 1 can comprise at least one actuator dedicated and configured for managing the step of opening the structure 1 and at least one actuator dedicated and configured for managing the step of closing the structure 1. The actuator 24, 25, 26, 27 is configured for determining such transitions between configurations of the structure 1 by pushing or pulling the floor element 11 and/or the ceiling element 14. Preferably, the structure 1 comprises a first actuator 24, 26 configured for pushing and/or pulling the floor element 11 and a second actuator 25, 27 configured for pushing and/or pulling the ceiling element 14.

In the embodiments illustrated in the enclosed figures, the structure 1 comprises a first actuator 24 configured for operating on the floor element 11 and a second actuator 25 configured for operating on the ceiling element 14. The first actuator 24 and the second actuator 25 can be configured for both pushing and pulling, respectively, the floor element 11 and on the ceiling element 14 in a manner such to manage both the step of opening and the step of closing the structure 1.

Figure 6:
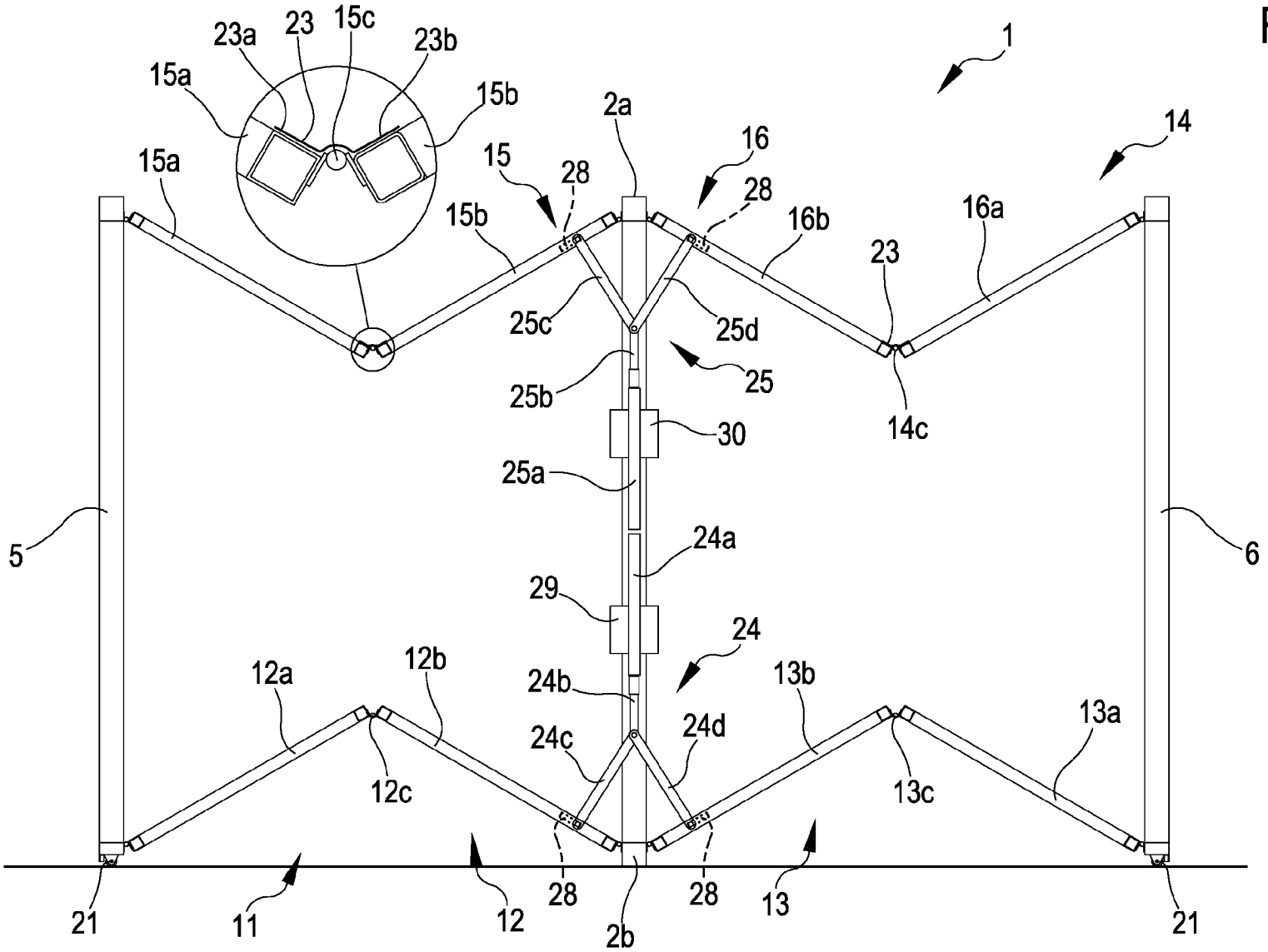
FIG. 6 represents the extendable structure of FIG. 5 in the opening step.
Figure 7:
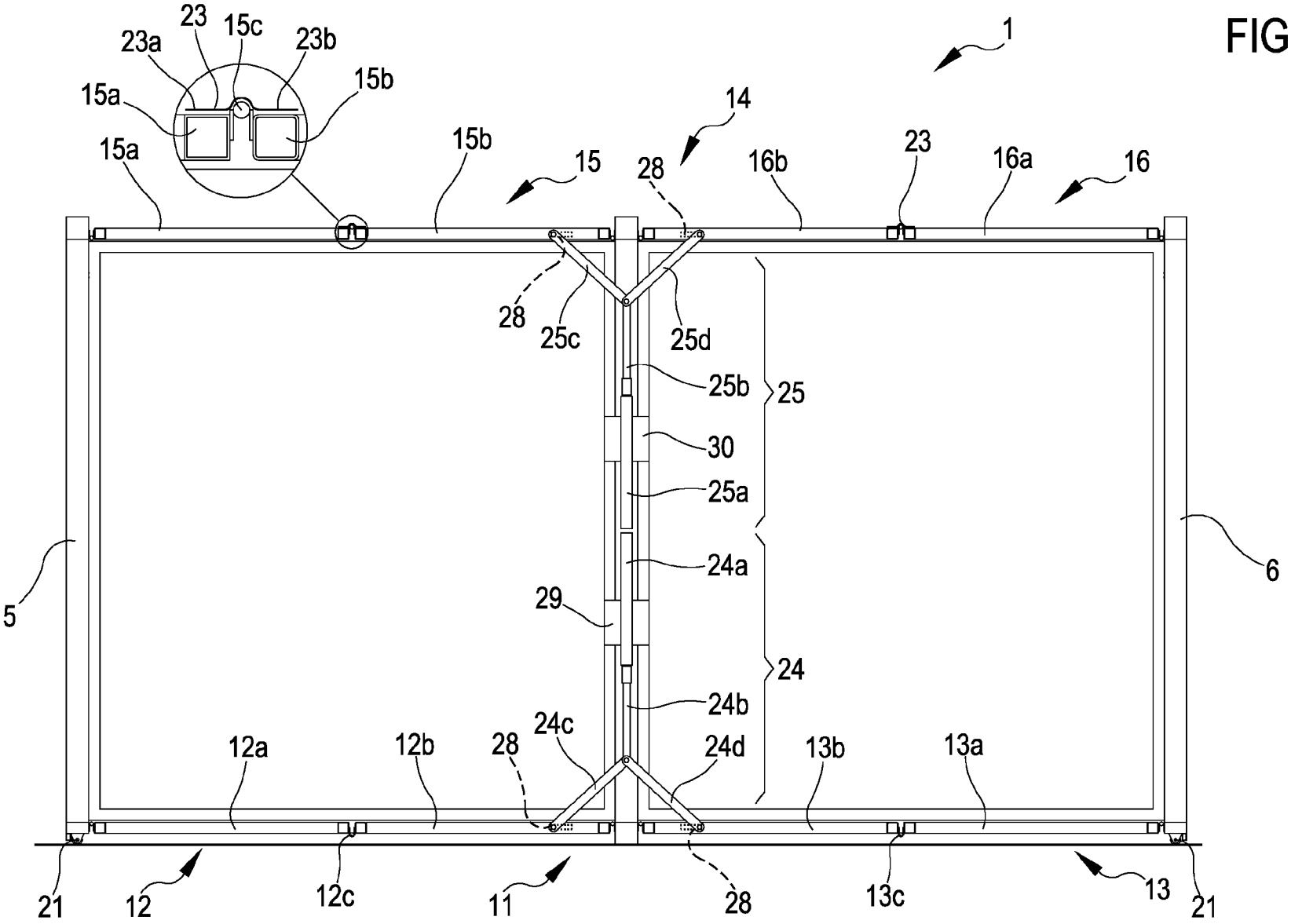
FIG. 7 represents the extendable structure of FIG. 6 in the completely extended configuration.

In the embodiment illustrated in FIGS. 5 to 7, the first actuator 24 operates on the foldable floor element 11 and comprises a seat 24*a* and a piston 24*b* housed and telescopically slidable within the seat 24*a*. The seat 24*a* has a solid of revolution symmetry and is preferably with cylindrical symmetry. The piston 24*b* is configured for telescopically sliding with respect to the seat 24*a* and for pushing and pulling the floor element 11. The piston 24*b* is configured for progressively exiting from the seat 24*a* so as to perform the action of pushing the floor element 11 (step of opening the structure 1) and is also configured for returning within the seat 24*a* so as to perform the pulling action on the floor element 11 (step of closing the structure 1). The first actuator 24 also comprises a first arm 24*c* and a second arm 24*d* hinged to one end of the piston 24*b*. The first arm 24*c* is connected to the second panel 12*b* of the first foldable floor portion 12 and is operatively interposed between the second panel 12*b* of the first foldable floor portion 12 and the piston 24*b*. The second arm 24*d* is connected to the second panel 13*b* of the second foldable floor portion 13 and is operatively interposed between the second panel 13*b* of the second foldable floor portion 13 and the piston 24*b*. The piston 24*b* pushes and pulls first foldable floor portion 12 by means of the first arm 24*c* and pushing or pulling the second foldable floor portion 13 by means of the second arm 24*d*. The first arm 24*c* and the second arm 24*d* are configured for being opened when subjected to the action of pushing the piston 24*b* and are configured for at least partially shutting when subjected to the pulling action of the piston 24*b*. The second actuator 25 operates on the foldable ceiling element 14 and preferably has a structure analogous to that of the first actuator 24. In particular, the second actuator 25 comprises a seat 25*a* and a piston 25*b* telescopically housed within the seat 25*a*. The seat 25*a* has a solid of revolution symmetry and is preferably with cylindrical symmetry. The piston 25*b* is configured for telescopically translating with respect to the seat 25*a* and for pushing and pulling the ceiling element 14. The piston 25*b* is configured for progressively exiting from the seat 25*a* so as to perform the action of pushing the ceiling element 14 (step of opening the structure 1) and is also configured for returning within the seat 25*a* so as to perform the pulling action on the ceiling element 14 (step of closing the structure 1). The second actuator 25 also comprises a first arm 25*c* and a second arm 25*d* hinged to one end of the piston 25*b*. The first arm 25*c* is connected to the second panel 15*b* of the first foldable ceiling portion 15 and is operatively interposed between the second panel 15*b* of the first foldable ceiling portion 15 and the piston 25*b*. The second arm 25*d* is connected to the second panel 16*b* of the second foldable ceiling portion 16 and is operatively interposed between the second panel 16*b* of the second foldable ceiling portion 16 and the piston 25*b*. The piston 25*b* pushes and pulls first foldable ceiling portion 15 by means of the first arm 25*c* and pushes and pulls the second foldable ceiling portion 16 by means of the second arm 25*d*. The first arm 25*c* and the second arm 25*d* are configured for being opened when subjected to the action of pushing the piston 25*b* and are configured for being at least partially shut when subjected to the pulling action of the piston 25*b*. Optionally, one end of each arm 24*c*, 24*d*, 25*c*, 25*d* of each actuator 24, 25 can be slidably housed within a respective guide 28 defined in the respective panel 12*a*, 12*b*, 13*a*, 13*b*, 15*a*, 15*b*, 16*a*, 16*b* with each each arm 24*c*, 24*d*, 25*c*, 25*d* is engaged. The guide 28 defines and delimits a travel for the respective arm 24*c*, 24*d*, 25*c*, 25*d*, one head thereof being housed therein. The end of the arm 24*c*, 24*d*, 25*c*, 25*d* slidable with respect to the respective guide 28 is opposite the end of the arm 24*c*, 24*d*, 25*c*, 25*d* hinged to a head of the respective piston 24*b*, 25*b*. The first and the second actuator 24, 25 can comprise a respective motor 29, 30 configured for actuating the respective piston 24*b*, 25*b*. In one variant, the structure 1 can provide for a single motor configured for actuating, selectively or simultaneously, the first actuator 24 and the second actuator 25. For the sake of completeness, it is indicated that in the embodiment pursuant to FIGS. 5 to 7, the uprights 3, 4 and the additional walls 17, 18, 19, 20 are not represented, which nevertheless can be provided for.

Figure 9:
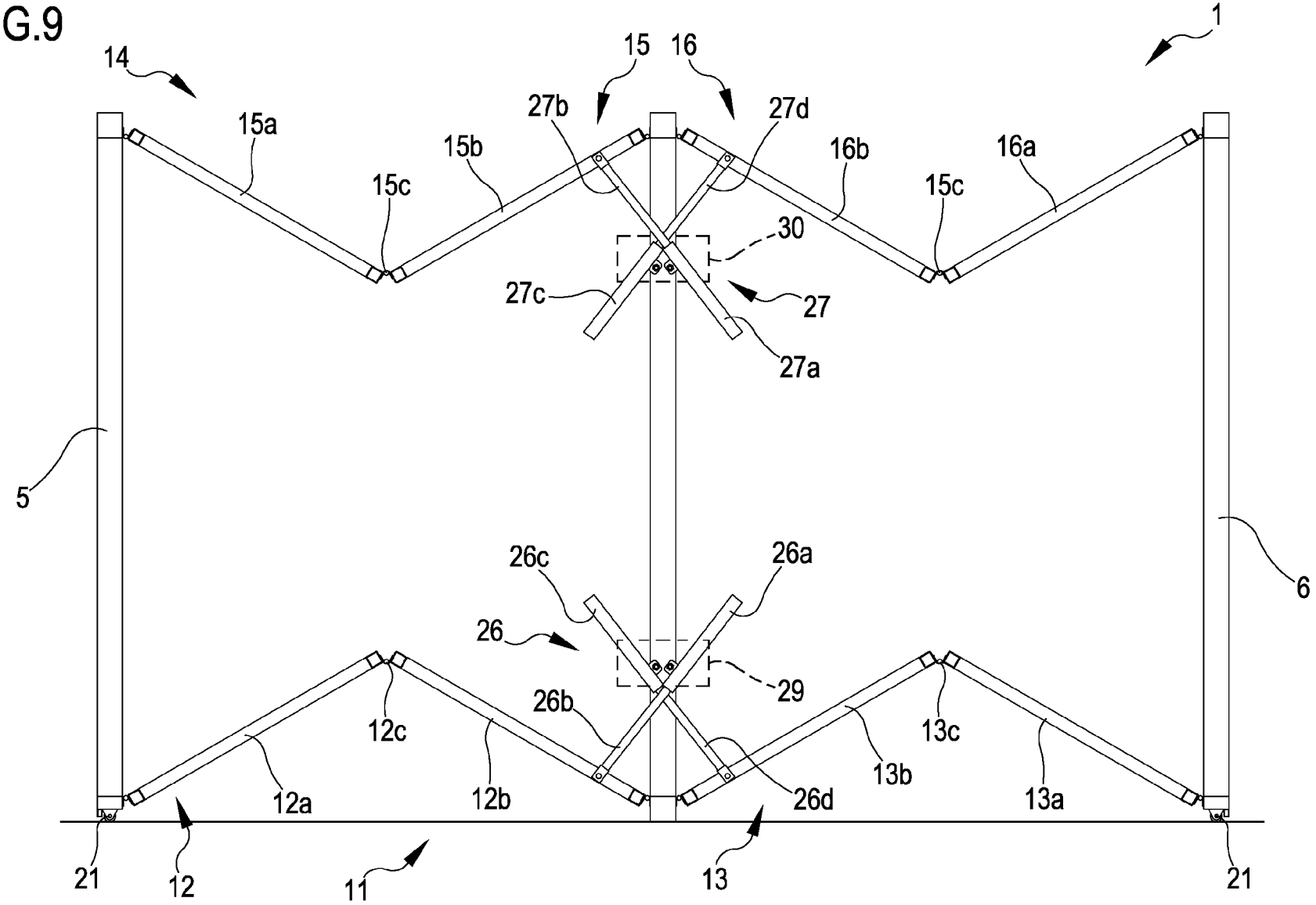
FIG. 9 represents the extendable structure of FIG. 8 in the opening step.
Figure 10:
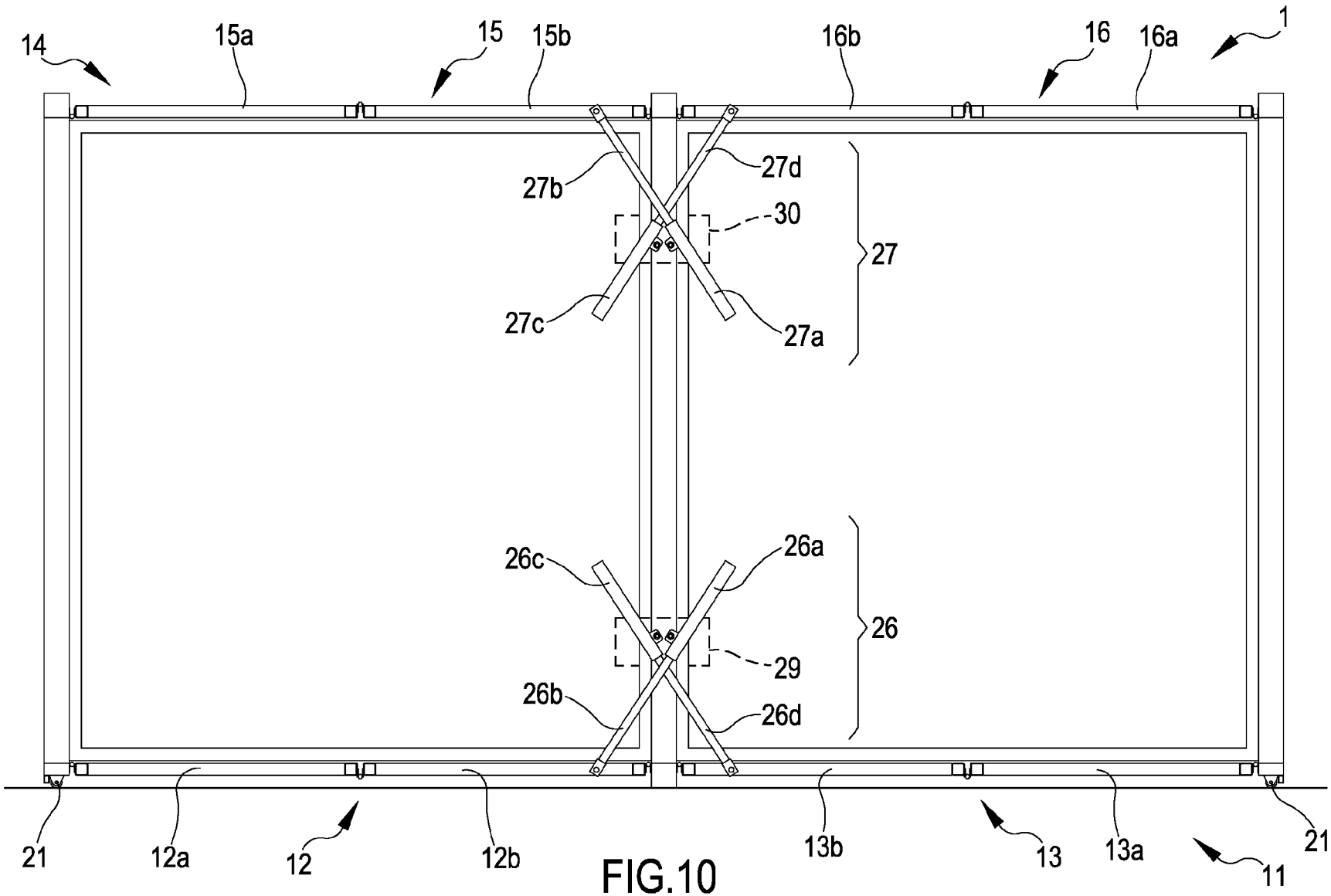
FIG. 10 represents the extendable structure of FIG. 9 in the completely extended configuration.

In the embodiment illustrated in FIGS. 8 to 10, an alternative with respect to the embodiment described above and illustrated in FIGS. 5 to 7, the first actuator 26 operates on the foldable floor element 11 and comprises a first seat 26*a* and a first piston 26*b* housed and telescopically slidable within the first seat 26*a*. In addition, the first actuator 26 comprises a second seat 26*c* and a second piston 26*d* housed and telescopically slidable within the second seat 26*c*. The first piston 26*b* and the first seat 26*a* are transverse to the second piston 26*d* and to the second seat 26*c*. Each seat 26*a*, 26*c* has a solid of revolution symmetry and is preferably with cylindrical symmetry. Each piston 26*b*, 26*d* is configured for telescopically sliding in a relative manner to the respective seat 26*a*, 26*c* and for pushing and pulling a respective foldable floor portion 12, 13. The first piston 26*b* is connected to the second panel 12*b* of the first foldable floor portion 12 in a manner such to push and pull the first foldable floor portion 12. The second piston 26*d* is connected to the second panel 13*b* of the second foldable floor portion 13 in a manner such to push and pull the second foldable floor portion 13. Each piston 26*b*, 26*d* is configured for progressively exiting from the respective seat 26*a*, 26*c* so as to perform the action of pushing the respective foldable floor portion 12, 13 to which it is connected (step of opening the structure 1) and it is also configured for returning within the respective seat 26*a*, 26*c* so as to perform the pulling action on the respective foldable floor portion 12, 13 to which it is connected (step of closing the structure 1). Optionally, the seats 26*a*, 26*c* can be hinged at or in proximity to the uprights 3, 4 in a manner such to rotate in the step of closing and opening the structure 1. The rotation of the seats 26*a*, 26*c*, and hence of the pistons 26*b*, 26*d* housed therein, is particularly advantageous in the step of closing the structure 1 since it allows the actuator 26 to assume, in the retracted configuration of the structure 1, a configuration with small or minimum size. The pistons 26*b*, 26*d* and the respective seats 26*a*, 26*c* can be configured for being opened when they push on the respective foldable floor portion 12, 13. In addition, the pistons 26*b*, 26*d* and the respective seats 26*a*, 26*c* can be configured for being at least partially shut when they pull the respective foldable floor portion 12, 13. The second actuator 27 operates on the foldable ceiling element 14 and preferably has a structure analogous to that of the first actuator 26. In particular, the second actuator 27 comprises a first seat 27*a* and a first piston 27*b* housed and telescopically slidable within the first seat 27*a*. In addition, the second actuator 27 comprises a second seat 27*c* and a second piston 27*d* housed and telescopically slidable within the second seat 27*a*, 27*c*. The first piston 27*b* and the first seat 27*a* are transverse to the second piston 27*d* and to the second seat 27*c*. Each seat 27*a*, 27*c* has a solid of revolution symmetry and is preferably with cylindrical symmetry. Each piston 27*b*, 27*d* is configured for sliding telescopically in a relative manner to the respective seat 27*a*, 27*c* and for pushing and pulling a respective foldable ceiling portion 15, 16. The first piston 27*b* is connected to the second panel 15*b* of the first foldable ceiling portion 15 in a manner such to push and pull the first foldable ceiling portion 15. The second piston 27*d* is connected to the second panel 16*b* of the second foldable ceiling portion 16 in a manner such to push and pull the second foldable ceiling portion 16. Each piston 27*b*, 27*d* is configured for progressively exiting from the respective seat 27*a*, 27*c* so as to carry out the action of pushing on the respective foldable ceiling portion 15, 16 to which it is engaged (step of opening the structure 1) and is also configured for returning within the respective seat 27*a*, 27*c* so as to perform the pulling action on the respective foldable ceiling portion 15, 16 with which it is engaged (step of closing the structure 1). The seats 27*a*, 27*c* can be hinged at or in proximity to the uprights 3, 4 in a manner such to rotate in the step of closing and step of opening the structure 1. The rotation of the seats 27*a*, 27*c*, and hence of the pistons 27*b*, 27*d* housed therein, is particularly advantageous in the step of closing the structure 1 since it allows the actuator 27 to assume, in the retracted configuration of the structure 1, a configuration with small or minimum size. The pistons 27*b*, 27*d* and the respective seats 27*a*, 27*c* can be configured for being opened when the push on the respective foldable ceiling portion 15, 16. In addition, the pistons 27*b*, 27*d* and the respective seats 27*a*, 27*c* can be configured for being at least partially shut when they pull the respective foldable ceiling portion 15, 16. Optionally, one end of each piston 26*b*, 26*d*, 27*b*, 27*d* of each actuator 26, 27 can be slidably housed within a respective guide defined in the respective panel 12*a*, 12*b*, 13*a*, 13*b*, 15*a*, 15*b*, 16*a*, 16*b* with which each piston 26*b*, 26*d*, 27*b*, 27*d* is engaged. The guide defines and delimits a travel for the respective piston 26*b*, 26*d*, 27*b*, 27*d*, one head thereof being housed therein.

The first and the second actuator 26, 27 can comprise a respective motor 29, 30 configured for actuating the respective pistons 26*b*, 26*d*, 27*b*, 27*d*. A first motor 29 operates on the first piston 26*b* and on the second piston 26*d* of the first actuator 26 and a second motor operates on the first piston 27*b* and on the second piston 27*d* of the second actuator. In one variant, the structure can provide for a single motor configured for actuating, selectively or simultaneously, the first actuator 26 and the second actuator 27. In one embodiment, the structure 1 can provide for a first actuator operating on the first foldable floor portion 12, a second actuator operating on the first foldable ceiling portion 15, a third actuator operating on the second foldable floor portion 13 and a fourth actuator operating on the second foldable ceiling portion 16. Each actuator can comprise a respective seat and a respective piston telescopically slidable within the respective seat in accordance with that described above. In such embodiment, the first, the second, the third and the fourth actuator can comprise a respective motor configured for actuating the respective piston. In one variant, the structure 1 can provide for a first motor configured for actuating a first pair of actuators and a second motor configured for actuating a second pair of actuators. The first pair of actuators can comprise the first actuator and the second actuator, or the first actuator and the third actuator, and the second pair of actuators can comprise the third actuator and the fourth actuator, or the second actuator and the fourth actuator. In a further variant, the structure 1 can provide for a single motor configured for actuating, selectively or simultaneously or in a predetermined time sequence, the first, the second, the third and the fourth actuator. For the sake of completeness, it is indicated that in the embodiment pursuant to FIGS. 8 to 10, the uprights 3, 4 and the additional walls 17, 18, 19, 20 are not represented, which can nevertheless be provided for.

In an alternative embodiment, the actuator or the actuators can operate directly in moving on the lateral walls 5, 6. In such embodiment, the movement of the lateral walls 5, 6 causes the folding and the spreading out of the floor element 11, of the ceiling element 14 and, of present, of the intermediate element.

In the embodiments and in the variants described with reference to the actuator or to the actuators 24, 25, 26, 27, the single actuator or the plurality of actuators 24, 25, 26, 27 is preferably completely housed within the box-like body 2 in the retracted configuration of the structure 1. The actuators 24, 25, 26, 27 can be housed within the box-like body 2 itself, in the volume defined between the first upright 3, the second upright 4, the first lateral wall 5 and the second lateral wall 6. FIG. 5 and FIG. 8 show retracted configurations of respective embodiments of the structure 1, from which the uprights 3, 4 have been omitted so as to illustrate the actuators 24, 25, 26, 27 and the compactness of the structure 1. Advantageously, since the actuator or the actuators 24, 25, 26, 27 are completely housed within the box-like body 2 in the retracted configuration of the structure 1, the structure 1 does not have external elements or additional sizes with respect to an overall size of the box-like body 2; this facilitates the transport of the structure 1 itself and the possibility of stacking it with other structures 1. Preferably, the actuators 24, 25, 26, 27 are arranged at a same distance from the first upright 3 and from the second upright 4 both in the retracted configuration of the structure 1 and in the completely extended configuration of the structure 1. In other words, the distance between uprights 3, 4 and actuators 24, 25, 26, 27 remains constant during the opening step and the step of closing the structure 1; during such steps, the distance between actuators 24, 25, 26, 27 and lateral walls 5, 6 instead varies due to the translation of the lateral walls 5, 6.

The present description also regards a use of the structure 1. The structure 1 can be used as temporary set-up. The use of the structure 1 as temporary set-up can for example be carried out at the time of specific events, such as sports events or trade fairs. The structure 1 can also be used as display space and/or information space. The use of the structure 1 can occur outdoors or indoors.

The present description also regards a method for moving the structure 1. The method provides for arranging a structure 1 of the previously described type.

The method provides for spreading out the foldable floor element 11 and the foldable ceiling element 14 in a manner so as to determine a transition of the structure 1 from the retracted configuration to the completely extended configuration. The steps of spreading out the foldable floor element 11 and the foldable ceiling element 14 are attained by moving the foldable floor element 11 and the foldable ceiling element 14 in a mirrored manner with respect to a plane crossing through a center line of the uprights 3, 4 orthogonal to a main extension direction D3, D4 of the uprights 3, 4 (see FIG. 2). In the embodiment in which an intermediate foldable element is also provided, the method can also provide for spreading out the intermediate foldable element in a manner so as to determine a transition of the structure 1 from the retracted configuration to the completely extended configuration. Such steps of spreading out enable the opening of the structure 1. Preferably, the steps of spreading out the foldable floor element 11 and of spreading out the foldable ceiling element 14 and, if present, of spreading out the intermediate foldable element, are attained simultaneously. In the embodiment which provides for a first foldable floor portion 12 and a second foldable floor portion 13, the step of spreading out of the foldable floor element 11 provides for spreading out the first foldable floor portion 12 and the second foldable floor portion 13. The steps of spreading out the first foldable floor portion 12 and the second foldable floor portion 13 are attained by moving, in a mirrored manner, the first foldable floor portion 12 and the second foldable floor portion 13 with respect to a plane crossing through the uprights 3, 4 parallel to a main extension direction D3, D4 of the uprights 3, 4. In the embodiment which provides a first foldable ceiling portion 15 and a second foldable ceiling portion 16, the step of spreading out the ceiling element 14 provides for spreading out the first foldable ceiling portion 15 and the second foldable ceiling portion 16. The steps of spreading out the first foldable ceiling portion 15 and the second foldable ceiling portion 16 are attained by moving, in a mirrored manner, the first foldable ceiling portion 15 and the second foldable ceiling portion 16 with respect to a plane crossing through the uprights 3, 4 parallel to a main extension direction D3, D4 of the uprights 3, 4. In the embodiment which provides for a first intermediate foldable portion and a second intermediate foldable portion, the step of spreading out the intermediate foldable element provides for spreading out the first intermediate foldable portion and the second intermediate foldable portion. The steps of spreading out the first intermediate foldable portion and the second intermediate foldable portion are attained by moving, in a mirrored manner, the first intermediate foldable portion and the second intermediate foldable portion with respect to a plane crossing through the uprights 3, 4 parallel to a main extension direction D3, D4 of the uprights 3, 4. The steps of spreading out the first foldable floor portion 12 and the first foldable ceiling portion 15 and, if present, the first intermediate foldable portion, are preferably attained simultaneously with respect to each other and cause the movement of the first lateral wall 5 in moving away from the uprights 3, 4. The steps of spreading out the second foldable floor portion 13 and the second foldable ceiling portion 16 and, if present, the second intermediate foldable portion, are preferably attained simultaneously with respect to each other and cause the movement of the second lateral wall 6 in moving away from the uprights 3, 4. In accordance with that described above, the spreading out of the foldable floor portions 12, 13, of the foldable ceiling portions 15, 16 and, if provided, of the intermediate foldable portions can be attained by means of one or more actuators 24, 25, 26, 27. The method for moving a structure 1 which provide for the use of at least one actuator 24, 25, 26, 27 is substantially a method for actuating a structure 1. The action of the actuators 24, 25, 26, 27 can cause the spreading out of the foldable portions 12, 13, 15, 16 and the consequent moving away of the lateral walls 5, 6 from the uprights 3, 4. In an alternative embodiment, the actuator or the actuators 24, 25, 26, 27 can operate directly in moving on the lateral walls 5, 6. In such embodiment, the movement of the first lateral wall 5 in moving away from the uprights 3, 4 causes the spreading out of the first foldable floor portion 12 and of the first foldable ceiling portion 15 and, if present, of the first intermediate foldable portion and the movement of the second lateral wall 6 in moving away from the uprights 3, 4 causes the spreading out of the second foldable floor portion 13 and of the second foldable ceiling portion 16 and, if present, of the second intermediate foldable portion. Preferably, the method provides for simultaneously moving the first lateral wall 5 and the second lateral wall 6 in moving away from the uprights 3, 4. The method can provide for moving the lateral walls 5, 6 in moving away from the uprights 3, 4 by means of elements for aiding the movement 21, such as small wheels. The method for moving a structure 1 which provide for the opening of the structure 1 is substantially a method for setting up a structure 1. The method can provide for moving additional walls 17, 18, 19, 20 with respect to the respective lateral walls 5, 6 to which they are hinged. The movement of the additional walls 17, 18, 19, 20 is carried out in the completely extended configuration of the structure 1. The movement of the additional walls 17, 18, 19, 20 is preferably a rotation and can be attained in accordance with that described above. The method can provide for moving the additional walls 17, 18, 19, 20 by means of one or more additional actuators. Alternatively, the method can provide for manually moving the additional walls 17, 18, 19, 20.

The method can also provide for folding the foldable floor element 11 and the foldable ceiling element 14 in a manner so as to determine a transition of the structure 1 from the completely extended configuration to the retracted configuration. Before our folding of the foldable floor element 11 and of the foldable ceiling element 14, the method can provide for the movement of the additional walls 17, 18, 19, 20 in approaching the respective lateral walls 5, 6 to which they are hinged. Such movement can be carried out via rotation of the additional walls 17, 18, 19, 20 with respect to the respective lateral walls 5, 6 up to reaching the configuration illustrated in FIG. 3, in which the additional walls 17, 18, 19, 20 are moved close to and face the respective lateral walls 5, 6. The steps of folding the foldable floor element 11 and the foldable ceiling element 14 are attained by moving the foldable floor element 11 and the foldable ceiling element 14 in a mirrored manner with respect to a plane crossing through a center line of the uprights 3, 4 orthogonal to a main extension direction D3, D4 of the uprights 3, 4. In the embodiment in which also an intermediate foldable element is provided, the method can also provide for folding the intermediate foldable element in a manner so as to determine a transition of the structure 1 from the completely extended configuration to the retracted configuration. Such folding steps enable the closure of the structure 1. Preferably, the steps of folding the foldable floor element 11 and of folding the foldable ceiling element 14 and, if present, of folding the intermediate foldable element, are attained simultaneously. In the embodiment which provides for a first foldable floor portion 12 and a second foldable floor portion 13, the step of folding of the foldable floor element 11 provides for folding the first foldable floor portion 12 and the second foldable floor portion 13. The steps of folding of the first foldable floor portion 12 and the second foldable floor portion 13 are attained by moving, in a mirrored manner, the first foldable floor portion 12 and the second foldable floor portion 13 with respect to a plane crossing through the uprights 3, 4 parallel to a main extension direction D3, D4 of the uprights 3, 4. In the embodiment which provides for a first foldable ceiling portion 15 and a second foldable ceiling portion 16, the step of folding the foldable ceiling element 14 provides for folding the first foldable ceiling portion 15 and the second foldable ceiling portion 16. The steps of folding the first foldable ceiling portion 15 and the second foldable ceiling portion 16 are attained by moving, in a mirrored manner, the first foldable ceiling portion 15 and the second foldable ceiling portion 16 with respect to a plane crossing through the uprights 3, 4 parallel to a main extension direction D3, D4 of the uprights 3, 4. In the embodiment which provides for a first intermediate foldable portion and a second intermediate foldable portion, the step of folding the intermediate foldable element provides for folding the first intermediate foldable portion and the second intermediate foldable portion. The steps of folding the first intermediate foldable portion and the second intermediate foldable portion are attained by moving, in a mirrored manner, the first intermediate foldable portion and the second intermediate foldable portion with respect to a plane crossing through the uprights 3, 4 parallel to a main extension direction D3, D4 of the uprights 3, 4. The steps of folding the first foldable floor portion 11 and the first foldable ceiling portion 15 and, if present, the first intermediate foldable portion, are preferably attained simultaneously with respect to each other and cause the movement of the first lateral wall 5 in approaching the uprights 3, 4. The steps of folding the second foldable floor portion 13 and the second foldable ceiling portion 16 and, if present, the second intermediate foldable portion, are preferably attained simultaneously with each other and cause the movement of the second lateral wall 6 in approaching the uprights 3, 4. In accordance with that described above, the folding the foldable floor portions 12, 13, of the foldable ceiling portions 15, 16 and, if provided, of the intermediate foldable portions can be attained by means of one or more actuators 24, 25, 26, 27. The action of the actuators 24, 25, 26, 27 can cause the folding of the foldable portions 12, 13, 15, 16 and the consequent approaching of the lateral walls 5, 6 to the uprights 3, 4. In an alternative embodiment, the actuator or the actuators 24, 25, 26, 27 can operate directly in moving on the lateral walls 5, 6. In such embodiment, the movement of the first lateral wall 5 in approaching the uprights 3, 4 causes the folding of the first foldable floor portion 12 and of the first foldable ceiling portion 15 and, if present, of the first intermediate foldable portion and the movement of the second lateral wall 6 in approaching the uprights 3, 4 causes the folding of the second foldable floor portion 13 and of the second foldable ceiling portion 16 and, if present, of the second intermediate foldable portion. Preferably, the method provides for simultaneously moving the first lateral wall 5 and the second lateral wall 6 in approaching the uprights 3, 4. The method can provide for moving the lateral walls 5, 6 in approaching the uprights 3, 4 by means of elements for aiding the movement 21, such as small wheels. The method for moving a structure 1 which provides for closing the structure 1 is substantially a method for retracting or dismantling a structure 1.

Advantages of the Invention

The present description allows obtaining one or more of the following advantages and resolving one or more of the problems encountered in the prior art.

First of all, the invention provides an extendable structure 1 which can be put away and stored in a limited volume; this is possible through folded arrangement of the above-described floor element 11 and ceiling element 14. The foldability of the floor element 11, of the ceiling element 14 and, where provided, of the intermediate element, confer compactness to the structure 1, which is seen in the minimum size of the box-like body 2 in the retracted configuration of the structure 1. In volumetric terms, the structure 1 has an overall size in the retracted configuration which can be advantageously smaller than one third or one fourth or one fifth with respect to a size that the structure 1 has in the completely extended configuration.

Advantageously, due to the limited size of the box-like body 2, in the retracted configuration the extendable structure 1 is easily transportable. Consequently, the structure 1 can be easily transported to a desired place, open or closed, where a display space and/or information space is set up by means of the extendable structure. The transportability of the extendable structure 1 is particularly advantageous if it is necessary to temporarily set up a display space and/or information space; such requirement is particularly important in sports events or trade fairs.

The extendable structure 1 can also advantageously be, in the retracted configuration thereof, easily stackable with other structures 1 in retracted configuration. Being stackable, a plurality of extendable structures 1 can be stored in a limited space, e.g. in view of a subsequent use thereof.

A further advantage is represented by the fact that the extendable structure 1 according to the invention can be side by side other extendable structures 1, both in retracted configuration and in completely extended configuration.

The extendable structure 1 in accordance with the invention advantageously has both a minimum size in the retracted configuration, and a spacious internal volume in the completely extended configuration. The internal volume that the extendable structure 1 has in the completely extended configuration is advantageously at least equal to three times or four times or five times a volume that the structure has in the retracted configuration.

In addition, the invention advantageously provides an extendable structure 1 which, being substantially hollow in the completely extended configuration, has a limited weight. The relative lightness of the structure 1 advantageously facilitates the transport thereof.

An additional advantage of the invention is represented by the fact that the extendable structure 1, in its completely extended configuration, is self-supporting and therefore does not require support elements outside the structure itself.

Advantageously, the structure 1 according to the invention can be easily opened or closed in limited time periods.

The structure allows speeding up the opening and closing operations with respect to the known solutions.

The extendable structure 1 in accordance with the invention preferably does not require tools for being set up.

An additional advantage of the invention is constituted by the fact that the extendable structure 1 can be modular and can therefore be modulated or designed as a function of the specific use needs of the structure 1 itself.

Further advantages are relative to the method for moving an extendable structure 1 in accordance with the invention. The method for moving an extendable structure 1 in accordance with the invention advantageously allows setting up and retracting an extendable structure 1, if necessary, by means of a few simple steps.

Advantageously, the method for moving an extendable structure 1 according to the invention also allows setting up and retracting an extendable structure 1, if necessary, easily and in limited time periods.

By means of the movement method according to the invention, it is possible to set up an extendable structure 1 in a desired place.

Advantageously, by providing for suitable actuators 24, 25, 26, 27, the setting up and the retraction or dismantling of the extendable structure 1 can be attained in a manner that is substantially automatic or semi-automatic or automatized or semi-automatized.

The method for moving an extendable structure 1 in accordance with the invention preferably might not provide for the use of tools for the setting up and the retraction or dismantling of the extendable structure 1.

The invention is also convenient to use and easy to actuate.

The invention claimed is:

1. Extendable structure (1) adapted to operate between a retracted configuration and at least one at least partially extended configuration, the extendable structure (1) comprising:

a box-shaped body (2) comprising at least one upright (3, 4), a width (W3, W4) of said at least one upright (3, 4) defining, in the retracted configuration of the extendable structure (1), a width (W2) of the box-shaped body (2), a foldable floor element (11) hinged in proximity to or at a lower portion (3*b*, 4*b*) of said at least one upright (3, 4), in the retracted configuration of the extendable structure (1) the foldable floor element (11) being folded and being placed in proximity to said at least one upright (3, 4), in a step of opening the extendable structure (1)—aimed to determine a transition of the extendable structure (1) from the retracted configuration to said at least one at least partially extended configuration—the foldable floor element (11) being transversely spread out, at least partially away from said at least one upright (3, 4), in a completely extended configuration of the extendable structure (1), the foldable floor element (11) being substantially flat and transverse to said at least one upright (3, 4), a foldable ceiling element (14) hinged in proximity to or at an upper portion (3*a*, 4*a*) of said at least one upright (3, 4), in the retracted configuration of the extendable structure (1) the foldable ceiling element (14) being folded and being placed in proximity to said at least one upright (3, 4), in the step of opening the extendable structure (1)—aimed to determine the transition of the extendable structure (1) from the retracted configuration to said at least one at least partially extended configuration—the foldable ceiling element (14) being transversely spread out, at least partially away from said at least one upright (3, 4), in the completely extended configuration of the extendable structure (1) the foldable ceiling element (14) being substantially flat and transverse to said at least one upright (3, 4), wherein, in the retracted configuration of the extendable structure (1), the foldable floor element (11) and the foldable ceiling element (14) are housed within the box-shaped body (2) and the box-shaped body (2) defines an overall size of the extendable structure (1);

wherein the extendable structure (1) also comprises at least one actuator (24, 25; 26, 27) configured for determining the transition of the extendable structure (1) from the retracted configuration to said at least one at least partially extended configuration, said at least one actuator (24, 25; 26, 27) being configured also for determining the transition of the extendable structure (1) from said at least one at least partially extended configuration to the retracted configuration, wherein said at least one actuator (24, 25; 26, 27) is arranged at or in proximity to said at least one upright (3, 4) and is housed, in the retracted configuration of the extendable structure (1), within the box-shaped body (2), said at least one actuator (24, 25; 26, 27) being operatively connected to at least one of the foldable floor element (11) and the foldable ceiling element (14) and being configured for at least partially moving at least one of the foldable floor element (11) and the foldable ceiling element (14), the movement of at least one of the foldable floor element (11) and of the foldable ceiling element (14) determining the folding or the spreading out thereof;

wherein the box-shaped body (2) also comprises at least one lateral wall (5, 6), in the retracted configuration of the extendable structure (1) said at least one lateral wall (5, 6) being placed in proximity to said at least one upright (3, 4) and laterally delimiting the box-shaped body (2) defining a side thereof, in said at least one at least partially extended configuration of the extendable structure (1) said at least one lateral wall (5, 6) being spaced with respect to said at least one upright (3, 4), wherein the foldable floor element (11) is hinged in proximity to or at a lower portion (5*b*, 6*b*) of said at least one lateral wall (5, 6) and the foldable ceiling element (14) is hinged in proximity to or at an upper portion (5*a*, 6*a*) of said at least one lateral wall (5, 6), and wherein in the opening step the spreading out of the foldable ceiling element (14) and the foldable floor element (11) determines a moving away of said at least one lateral wall (5, 6) from said at least one upright (3, 4), in a step of closing the extendable structure (1)—aimed to determine the transition of the extendable structure (1) from said at least one at least partially extended configuration or from the completely extended configuration to the retracted configuration—the folding of the foldable ceiling element (14) and the foldable floor element (11) determining an approach of said at least one lateral wall (5, 6) to said at least one upright (3, 4);

wherein the foldable ceiling element (14) and the foldable floor element (11) are extended at a same side of said at least one upright (3, 4) and are configured for being moved in a mirrored manner with respect to a plane crossing through a center line of said at least one upright (3, 4) orthogonal to a main extension direction (D3, D4) of said at least one upright (3, 4), the center line being defined with reference to the main extension direction (D3, D4) of said at least one upright (3, 4), in which the foldable ceiling element (14) comprises a first foldable ceiling portion (15) and a second foldable ceiling portion (16) extending at opposite sides of said at least one upright (3, 4) and the foldable floor element (11) comprises a first foldable floor portion (12) and a second foldable floor portion (13) extending at opposite sides of said at least one upright (3, 4), the first foldable ceiling portion (15) and the second foldable ceiling portion (16) being configured for being moved in a mirrored manner with respect to a plane crossing through said at least one upright (3, 4) parallel to the main extension direction (D3, D4) of said at least one upright (3, 4), the first foldable floor portion (12) and the second foldable floor portion (13) being configured for being moved in said mirrored manner with respect to the plane crossing through said at least one upright (3, 4) parallel to the main extension direction (D3, D4) of said at least one upright (3, 4); and wherein said at least one actuator (24, 25; 26, 27) includes a first actuator (24; 26) and a second actuator (25; 27) both being arranged at or in proximity to said at least one upright (3, 4) and housed, in the retracted configuration of the extendable structure (1), within the box-shaped body (2), the first actuator (24; 26) being operatively connected to the foldable floor element (11) and being configured for at least partially moving the floor element (11), the second actuator (25; 27) being operatively connected to the foldable ceiling element (14) and being configured for at least partially moving the foldable ceiling element (14).

2. The extendable structure (1) according to claim 1, wherein the foldable floor element (11) comprises at least one first panel (12*a*, 13*a*) and one second panel (12*b*, 13*b*) hinged to each other, in the retracted configuration of the extendable structure (1) the first panel (12*a*, 13*a*) and the second panel (12*b*, 13*b*) facing and being substantially parallel to each other and being placed in proximity to said at least one upright (3, 4), in the step of opening the extendable structure (1)—aimed to determine the transition of the extendable structure (1) from the retracted configuration to said at least one at least partially extended configuration—the first panel (12*a*, 13*a*) and the second panel (12*b*, 13*b*) rotating in a relative manner around a hinge (12*c*, 13*c*) at least partially away from said at least one upright (3, 4), in the completely extended configuration of the extendable structure (1) the first panel (12*a*, 13*a*) and the second panel (12*b*, 13*b*) being substantially coplanar and parallel to each other and orthogonal at least to the lower portion (3*b*, 4*b*) of said at least one upright (3, 4), and wherein the foldable ceiling element (14) comprises at least one first panel (15*a*, 16*a*) and a second panel (15*b*, 16*b*) hinged together, in the retracted configuration of the extendable structure (1) the first panel (15*a*, 16*a*) and the second panel (15*b*, 16*b*) facing and being substantially parallel to each other and being placed in proximity to said at least one upright (3, 4), in the step of opening the extendable structure (1)—aimed to determine the transition of the extendable structure (1) from the retracted configuration to said at least one at least partially extended configuration—the first panel (15*a*, 16*a*) and the second panel (15*b*, 16*b*) rotating in a relative manner around a hinge (15*c*, 16*c*) at least partially away from said at least one upright (3, 4), in the completely extended configuration of the extendable structure (1) the first panel (15*a*, 16*a*) and the second panel (15*b*, 16*b*) being substantially coplanar and parallel to each other and orthogonal at least to the upper portion (3*a*, 4*a*) of said at least one upright (3, 4).

3. The extendable structure (1) according to claim 1, also comprising at least one element for aiding movement (21), such element engaged at or in proximity to the lower end (5*b*, 6*b*) of said at least one lateral wall (5, 6), said at least one element for aiding the movement (21) being configured for facilitating the movement of said at least one lateral wall (5, 6) away from said at least one upright (3, 4) in the step of opening the extendable structure (1) and closer to said at least one upright (3, 4) in a step of closing the extendable structure (1)—aimed to determine the transition of the extendable structure (1) from said at least one at least partially extended configuration or from a completely extended configuration to the retracted configuration.

4. The extendable structure (1) according to claim 1, wherein the box-shaped body (2) comprises a first lateral wall (5) and a second lateral wall (6), in the retracted configuration of the extendable structure (1) the first lateral wall (5) and the second lateral wall (6) being placed in proximity to said at least one upright (3, 4) and laterally delimiting the box-shaped body (2) respectively defining opposite sides thereof, in said at least one at least partially extended configuration of the extendable structure (1) the first lateral wall (5) and the second lateral wall (6) being spaced with respect to said at least one upright (3, 4), wherein the foldable floor element (11) comprises a first foldable floor portion (12) and a second foldable floor portion (13) respectively engaged in proximity to opposite sides of the lower portion (3*b*, 4*b*) of said at least one upright (3, 4), a lower portion (5*b*) of the first lateral wall (5) being connected to one end of the first foldable floor portion (12) and a lower portion (6*b*) of the second lateral wall (6) being connected to one end of the second foldable floor portion (13), the spreading out of the first foldable floor portion (12) or of the second foldable floor portion (14) determining a moving away respectively of the first lateral wall (5) or of the second lateral wall (6) from said at least one upright (3, 4), the folding of the first foldable floor portion (12) or of the second foldable floor portion (13) determining an approach respectively of the first lateral wall (5) or of the second lateral wall (6) to said at least one upright (3, 4), and wherein the foldable ceiling element (14) comprises a first foldable ceiling portion (15) and a second foldable ceiling portion (16) respectively engaged in proximity to opposite sides of the upper portion (3*a*, 4*a*) of said at least one upright (3, 4), an upper portion (5*a*) of the first lateral wall (5) being connected to one end of the first foldable ceiling portion (15) and an upper portion (6*a*) of the second lateral wall (6) being connected to one end of the second foldable ceiling portion (16), the spreading out of the first foldable ceiling portion (15) or of the second foldable ceiling portion (16) determining a moving away respectively of the first lateral wall (5) or of the second lateral wall (6) from said at least one upright (3, 4), the folding of the first foldable ceiling portion (15) or of the second foldable ceiling portion (16) determining an approach respectively of the first lateral wall (5) or of the second lateral wall (6) to said at least one upright (3, 4).

5. The extendable structure (1) according to claim 1, wherein the box-shaped body (2) comprises a first upright (3) and a second upright (4) substantially parallel to each other, the foldable floor element (11) being hinged to the first upright (3) and to the second upright (4) at respective lower portions (3*b*, 4*b*) of said first upright (3) and second upright (4) and the foldable ceiling element (14) being hinged to the first upright (3) and to the second upright (4) at respective upper portions (3*a*, 4*a*) of said first upright (3) and second upright (4), a distance between the first upright (3) and the second upright (4) substantially defining a depth (P2) of the box-shaped body (2), the distance between the first upright (3) and the second upright (4) being defined orthogonal to at least one of the first and the second upright (3, 4).

6. The extendable structure (1) according to claim 1, also comprising at least one additional wall (17, 18, 19, 20) hinged to said at least one lateral wall (5, 6), said at least one additional wall (17, 18, 19, 20) being configured for integrally translating with said at least one lateral wall (5, 6) during the step of opening the extendable structure (1), in the completely extended configuration of the extendable structure (1) said at least one additional wall (17, 18, 19, 20) being configured for rotating with respect to said at least one lateral wall (5, 6) around a hinge up to taking on a positioning orthogonal to said at least one lateral wall (5, 6) and defining a confinement wall of the extendable structure (1).

7. The extendable structure (1) according to claim 6, wherein the extendable structure (1) comprises a first additional wall (17, 19) and a second additional wall (18, 20) hinged in proximity to or at respective opposite sides of said at least one lateral wall (5, 6), the first additional wall (17, 19) and the second additional wall (18, 20) being configured for integrally translating with said at least one lateral wall (5, 6) during the step of opening the extendable structure (1), in the completely extended configuration of the extendable structure (1) the first additional wall (17, 19) and the second additional wall (18, 20) being configured for selectively rotating with respect to said at least one lateral wall (5, 6) around a respective hinge up to taking a respective positioning orthogonal to said at least one lateral wall (5, 6) and defining respective confinement walls of the extendable structure (1), the confinement wall defined by the first additional wall (17, 19) being opposite the confinement wall defined by the second additional wall (18, 20) with reference to said at least one lateral wall (5, 6).

8. Method for moving an extendable structure (1) comprising at least the following steps:

arranging an extendable structure (1) adapted to operate between a retracted configuration and at least one at least partially extended configuration and comprising:

a box-shaped body (2) comprising at least one upright (3, 4), in the retracted configuration of the extendable structure (1) the box-shaped body (2) defining an overall size of the extendable structure (1), a foldable floor element (11) hinged in proximity to or at a lower portion (3*b*, 4*b*) of said at least one upright (3, 4), and a foldable ceiling element (14) hinged in proximity to or at an upper portion (3*a*, 4*a*) of said at least one upright (3, 4), at least one lateral wall (5, 6), in the retracted configuration of the extendable structure said at least one lateral wall being placed in proximity to said at least one upright and laterally delimiting the box-shaped body, defining one side thereof;

in the retracted configuration of the extendable structure (1) the foldable floor element (11) and the foldable ceiling element (14) being housed within the box-shaped body (2), spreading out the foldable floor element (11) so as to determine a transition of the extendable structure (1) from the retracted configuration to said at least one at least partially extended configuration or folding the foldable floor element (11) so as to determine a transition of the extendable structure (1) from said at least one at least partially extended configuration to the retracted configuration, said step of spreading out or folding the floor element (11) being attained by means of a first actuator, spreading out the foldable ceiling element (14) so as to determine a transition of the extendable structure (1) from the retracted configuration to said at least one at least partially extended configuration or folding the foldable ceiling element (14) so as to determine a transition of the extendable structure (1) from said at least one at least partially extended configuration to the retracted configuration, said step of spreading out or folding the ceiling element (14) being attained by means of a second actuator;

rigidly translating said at least one lateral wall;

wherein the step of spreading out or folding the foldable ceiling element and the step of spreading out or folding the foldable floor element are simultaneous;

wherein the step of spreading out or folding the floor element and the step of spreading out or folding the ceiling element cause the rigid translation of said at least one lateral wall; and wherein the extendable structure (1) is the extendable structure of claim 1.

* * * * *